US006783200B2

(12) United States Patent
Suenaga et al.

(10) Patent No.: US 6,783,200 B2
(45) Date of Patent: Aug. 31, 2004

(54) INK JET RECORDING APPARATUS

(75) Inventors: Kouji Suenaga, Ebina (JP); Tatsuhiro Ishize, Ebina (JP); Kazuyuki Oda, Ebina (JP); Mitsuhide Soga, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 71 days.

(21) Appl. No.: 10/003,480

(22) Filed: Dec. 6, 2001

(65) Prior Publication Data

US 2002/0167556 A1 Nov. 14, 2002

(30) Foreign Application Priority Data

May 9, 2001 (JP) ..... 2001-139265

(51) Int. Cl.[7] ..... B41J 2/195
(52) U.S. Cl. ..... 347/7
(58) Field of Search ..... 347/5, 7, 19, 14, 347/85–87

(56) References Cited

U.S. PATENT DOCUMENTS 5,623,290 A * 4/1997 Iida et al. ..... 347/7
6,488,348 B1 * 12/2002 Miura et al. ..... 347/6

FOREIGN PATENT DOCUMENTS

| | | | |
|---|---|---|---|
| JP | 10-6521 | 1/1998 | |
| JP | 10-114084 | 5/1998 | |
| JP | 10-315493 | 12/1998 | |
| JP | 10315501 A | * 12/1998 | ..... 347/7 |
| JP | 11-58768 | 3/1999 | |
| JP | 11-227220 | 8/1999 | |

* cited by examiner

*Primary Examiner*—Stephen D. Meler
*Assistant Examiner*—An H. Do
(74) *Attorney, Agent, or Firm*—Morgan, Lewis & Bockius LLP

(57) ABSTRACT

The present invention provides an ink jet recording apparatus which can prevent problems such as image defects caused by shortage of ink, and decreases in the printing speed from occurring. When execution of a print job is instructed, a printing processing for the print job is started. The number of pixels which have been actually printed is added to a current pixel count C1, and it is determined whether or not the print job is finished. When it is determined that the print job is finished and the pixel count C1 exceeds a predetermined number of pixels X1, an ink supply unit is controlled so that ink of a predetermined proportion A (%) of the amount of ink used, which amount corresponds to the pixel count C1, is supplied to a sub-ink tank.

19 Claims, 16 Drawing Sheets

EXAMPLE OF DISPLAY

EXAMPLE OF INDICATOR

INK JET RECORDING APPARATUS

BACKGROUND OF THE INVENTION

1. Field of the Invention

The present invention relates to an ink jet recording apparatus, and specifically, to an ink jet recording apparatus in which an image is recorded by jetting droplets onto a recording medium based on image information.

2. Description of the Related Art

Japanese Patent Application Laid-Open (JP-A) Nos. 10-6521 and 10-114084 disclose an ink jet recording apparatus which includes a sub-ink tank provided at a recording head, a main tank for supplying ink to the sub-ink tank, and an ink sensor for detecting the amount of ink in the sub-ink tank. When the ink sensor detects that the amount of ink in the sub-ink tank is the lower limit or less, ink is supplied from the main tank to the sub-ink tank.

When other operations are stopped in order to supply ink, efficiency decreases. Therefore, JP-A No. 10-315493 discloses an ink jet image forming apparatus in which the other operations can continue even while ink is supplied. The ink jet image forming apparatus is constructed to supply ink only at a fixed time: before conversion of image data ends or after image formation. Ink supplying occurs during a time period where it is possible to sufficiently fill the sub-ink tank, regardless of whether this time period is during the image data conversion or after the image formation.

JP-A No. 11-227220 discloses an ink jet recording apparatus in which the amount of ink jetted and discharged from a head portion is calculated, and the amount of ink to be supplied is controlled in accordance with the results of the calculation or the results of detecting the level of the ink surface in a sub-ink tank by a float.

JP-A No. 11-58768 discloses an ink jet recording apparatus which includes an ink amount sensor mounted to an ink tank for detecting the amount of ink in the ink tank. When shortage of ink is detected by the ink amount sensor during printing, the number of passes and the number of pages are determined based on the detection results, and ink is supplied to the ink tank after a predetermined printing processing.

JP-A Nos. 10-6521 and 10-114084 do not, however, clearly specify when the amount of ink in the sub-ink tank is detected. Therefore, when ink is to be supplied during a printing processing, it is necessary to slow down or stop the printing processing first and then supply ink in order to maintain print quality. As a result, the printing speed decreases. Further, when the level of the ink in the sub-ink tank does not reach a predetermined position, it is determined that ink in the main tank has run out. This means that ink supply operations are performed more than necessary. Thus, it takes a long time before it is determined that ink in the main tank has run out.

Moreover, in the structure of the ink jet image forming apparatus disclosed in JP-A No. 10-315493, when an insufficient amount of ink is detected during execution of a print job including a plurality of pages, ink can only be supplied during image data conversion. Therefore, a printing operation for a subsequent page may be implemented without a sufficient amount of ink being supplied to the sub-ink tank, and ink may run out before printing of the subsequent pages is finished. Further, ink is supplied after image formation, thereby decreasing the printing speed.

JP-A No. 10-315493 also discloses a structure in which ink is supplied during image formation and ink supplying continues for a predetermined time even after the image formation. In this structure, however, the standby time between printing of a page and printing of a subsequent page becomes long. As a result, a problem arises in that the printing speed decreases.

In the ink jet recording apparatus disclosed in JP-A No. 11-227220, when the amount of ink to be jetted varies with the environment, the amount of ink to be jetted becomes smaller or larger than the amount of ink actually jetted. As a result, the amount of ink supplied varies, and ink cannot be supplied in accordance with preset values. Further, since the amount of ink to be supplied is controlled by the float, ink supplying operations continue even if no ink is in the main tank.

In the ink jet recording apparatus disclosed in JP-A No. 11-58768, the number of pages which can be printed is determined based on the amount of ink in the ink tank, which amount is detected by the ink amount sensor. After a predetermined printing processing is finished, ink is supplied based on the determination result. However, in order to determine the number of pages which can be printed, not only whether the amount of ink in the ink tank is no more than a predetermined amount but also the amount of ink actually remaining in the ink tank need to be detected. Therefore, a problem arises in that the ink amount sensor is expensive. Further, in the case of printing an image which requires an ink amount equal to or larger than the amount of ink actually remaining in the ink tank, a problem of image defects arises since ink is not supplied to the ink tank during printing.

As described above, in the conventional ink jet recording apparatuses, the amount of ink in the ink tank for supplying ink to the recording head is detected, and when the amount is the lower limit or less, a signal indicating shortage of ink in the ink tank is outputted. When the amount of ink in the ink tank is insufficient, ink is supplied from a separate ink supply tank. However, since control of the timing of the ink supplying is insufficient, problems may arise in that image defects are caused due to shortage of ink in the ink tank and the printing speed decreases.

SUMMARY OF THE INVENTION

In order to achieve the above object, a first aspect of the present invention is an ink jet recording apparatus comprising: a recording head including an ink tank for storing ink, the recording head being driven and controlled based on image information so as to jet onto a recording medium ink supplied from the ink tank; detecting means for detecting the amount of ink remaining in the ink tank; supply means including a main tank for storing ink, the supply means supplying ink from the main tank to the ink tank when the recording head is disposed at an ink supplying position; and control means for controlling the supply means so that, when the remaining ink amount detected by the detecting means is above a lower limit, ink is supplied during non-recording time in an amount corresponding to the amount of ink used.

In this structure, when the remaining ink amount detected by the detecting means is above the lower limit of the ink in the ink tank, the control means controls the supply means so that ink is supplied from the main tank to the ink tank, which is disposed at the ink supplying position during non-recording time, in an amount corresponding to the amount of ink used. Non-recording time described herein (or during non-printing operations which will be described later) refers to time other than the time ink is jetted onto the recording medium, and typically refers to the time between recording jobs, the standby time for recording, or the preparation time for recording. Ink may be supplied during a job as long as the ink supply does not delay recording, and the non-recording time may be any length of time as long as it does not delay recording. Namely, ink is supplied to the ink tank during non-recording time in an amount corresponding to the amount of ink which has been used. Thus, the time the ink amount reaches the lower limit can be delayed. Further, image defects caused by shortage of ink, and decreases in the recording speed can be prevented. As a result, it is possible to significantly decrease the probability of recording being interrupted by shortage of ink.

The control means preferably estimates, based on the image information, the amount of ink used. Since jetting of ink by the recording head is controlled based on image information, the amount of ink used can be easily estimated by, for example, counting the number of pixels corresponding to the amount of ink jetted. This structure is simpler than a structure in which the amount of ink is actually measured. Further, it is preferable that the control means determines whether or not the amount of ink used exceeds a predetermined value, and when the determination is affirmative, the control means controls the supply means during non-recording time so that ink is supplied to the ink tank. The predetermined value preferably corresponds to an amount of ink which can be supplied during non-recording time without interrupting recording. In a preferable aspect, the predetermined value is no more than an upper limit of the ink remaining in the ink tank. In this way, it is possible to prevent a case in which the amount of ink remaining in the ink tank exceeds the upper limit because of errors in estimation of the amount of ink used, which errors are caused by environmental changes. Further, it suffices that the detecting means detects if the amount of ink remaining in the ink tank is above or below the lower limit. Therefore, another detecting means for detecting the upper limit of ink remaining in the ink tank is not necessary. As a result, this structure can be simplified and produced at a low cost. The lower limit is an amount of ink which can be used for a predetermined amount of printing. When the predetermined amount of printing is set as an amount by which predetermined recording quality can be maintained, even after it is detected that the amount of ink remaining in the ink tank is less than the lower limit, recording can be performed while the predetermined recording quality is maintained. The predetermined amount of printing preferably corresponds to the maximum amount of ink assumed to be used or an amount of ink to be used for a job which is frequently executed.

A second aspect of the present invention is an inkjet recording apparatus comprising: an inkjet recording head including an ink tank to which ink is supplied, the ink jet recording head printing by jetting the ink from the ink tank in accordance with image information in a print job; remaining ink amount detecting means for detecting the amount of ink remaining in the ink tank at predetermined time intervals and outputting an empty signal indicating shortage of ink when the ink amount is no more than a lower limit; ink supply means including a main tank for storing ink, the ink supply means supplying ink from the main tank to the ink tank in response to the empty signal outputted from the remaining ink amount detecting means; and control means for controlling the ink supply means such that, when the remaining ink amount detected by the remaining ink amount detecting means is above the lower limit, ink is supplied to the ink tank in an amount corresponding to the amount of ink used.

In the inkjet recording apparatus according to the second aspect, the remaining ink amount detecting means detects the amount of ink remaining in the ink tank at predetermined time intervals and outputs an empty signal indicating a shortage of ink when the remaining ink amount is no more than a lower limit. The ink supply means includes a main tank for storing ink and supplies ink from the main tank to the ink tank in response to the empty signal outputted from the remaining ink amount detecting means. The control means controls the ink supply means so that, when the remaining ink amount detected by the remaining ink amount detecting means at the predetermined time intervals is above the lower limit, ink is supplied to the ink tank in an amount corresponding to the amount of ink which has been used.

Since the ink jet recording apparatus according to the second aspect has the above-described structure, a period between the time ink is supplied to the ink tank to its upper limit and the time the amount of ink in the ink tank is detected can be made long. Further, before the amount of ink in the ink tank reaches the lower limit, ink is supplied to the ink tank in an amount corresponding to the amount of ink which has been used. Thus, a relatively large amount of ink is constantly held in the ink tank. Further, it is possible to lower the possibility of image defects being caused by shortage of ink during a printing processing for a print job which has a large coverage area and thus requires a large amount of ink. Therefore, the probability of the printing processing being interrupted by the ink supply operation significantly decreases, and as a result, throughput can be improved.

It is advantageous if the amount of ink to be supplied which corresponds to the amount of ink used is somewhat smaller than the amount which can be estimated based on the pixel count. Namely, the amount of ink which can be estimated based on the pixel count does not necessarily correspond with the amount of ink actually used. Therefore, it is possible to prevent a problem of oversupply of ink to the ink tank by supplying ink thereto in an amount less than the predetermined amount. An upper limit sensor is preferably provided at the ink tank so as to monitor the amount of ink therein, since ink can be supplied to the ink tank to its upper limit.

A third aspect of the present invention is an ink jet recording apparatus according to the second aspect, wherein the control means controls the ink supply means such that ink is supplied to the ink tank when the print job is not being printed.

According to the third aspect, in the ink jet recording apparatus of the second aspect, the timing of ink supply is limited to the time a print job is not being printed. The time a print job is not being printed refers to the time other than the time a printing processing is carried out, such as the time immediately before or after a printing processing for a print job, the time the power supply is turned on or off, the time a recording medium to be printed such as paper is loaded, and the time the operation mode of the apparatus is switched to sleep mode for power saving. Further, the apparatus can be structured such that a user can specify desired time such as lunch break. Furthermore, a period of time when few printing operations are performed may be automatically detected by the control means based on statistical data, and ink may be supplied during the detected period of time. Since ink is supplied with the above-described timing, the probability of the printing processing for a print job being interrupted by ink supply decreases. Therefore, throughput is substantially improved. Moreover, since ink is not supplied between printing of a page and printing of a subsequent page, it is possible to prevent a case in which a printing processing for a print job is interrupted by an ink supply processing, thereby keeping a user waiting.

A fourth aspect of the present invention is an ink jet recording apparatus according to the second aspect, wherein the remaining ink amount detecting means detects the amount of ink remaining in the ink tank over a first time interval until the ink amount reaches a predetermined amount larger than the lower limit, and detects the remaining ink amount over a second time interval, which is shorter than the first time interval, after the ink amount has reached the predetermined amount.

When the amount of ink in the ink tank is frequently detected, accuracy of detection is improved, but this frequent detection wastes time. Therefore, in the fourth aspect, the amount of ink remaining in the ink tank is detected over a first time interval until the ink amount reaches a predetermined amount which is relatively large, and the remaining ink amount is minutely detected over a second time interval, which is shorter than the first time interval, after the ink amount has reached the predetermined amount. In this way, the number of detection of the amount of ink in the ink tank is minimized.

As a result, the time required for stopping the operation of the apparatus for ink amount detection can be substantially decreased. Further, the amount of ink remaining in the ink tank can be detected immediately after the ink amount has reached the lower limit. The predetermined amount can be appropriately selected.

When a print job includes a large number of sheets, the amount of ink in the ink tank may become insufficient before printing of all the sheets is finished. Therefore, once a predetermined number of pixels is printed, the amount of ink in the ink tank may be detected during a printing processing as well. In this case, the printing processing is interrupted by the detection. Thus, in the case of an ink jet recording apparatus which has ink tanks for multiple colors so that full-color images are formed, it is preferable to detect only the amount of ink in an ink tank for a specific color when the amount of ink used exceeds an amount corresponding to the predetermined number of pixels.

A fifth aspect of the present invention is an ink jet recording apparatus according to the second aspect, wherein the remaining ink amount detecting means detects the remaining ink amount for every predetermined number of printed pixels, the predetermined number of printed pixels being smaller than the number of pixels which can be printed after the empty signal is outputted.

The amount of ink in the ink tank is detected when the remaining ink amount reaches the lower limit. However, even after the remaining ink amount has reached the lower limit, some ink remains in the ink tank. According to the fifth aspect, in the ink jet recording apparatus of the second aspect, the remaining ink amount detecting means detects the remaining ink amount for every predetermined number of printed pixels, which predetermined number of printed pixels is smaller than the number of pixels which can be printed with the ink remaining in the ink tank after the ink amount has reached the lower limit. In this way, a case in which ink in the ink tank runs out during printing so that further printing cannot be performed is prevented. The predetermined number of pixels for the ink amount detection is preferably set on the basis of the coverage area for the best quality. As a result, printing of files having a large coverage area can be ensured.

A sixth aspect of the present invention is an ink jet recording apparatus according to the second aspect, wherein, when the print job is not being printed, the remaining ink amount detecting means controls the amount of ink remaining in the ink tank by the number of pixels corresponding to the amount of ink jetted from the ink jet recording head and detects the remaining ink amount when the number of pixels exceeds a predetermined number.

When the amount of ink in the ink tank is detected directly, the remaining ink amount can be more accurately detected as compared with cases in which the remaining ink amount is detected based on the number of pixels. However, this direct detection takes time. Thus, according to the sixth aspect, in the ink jet recording apparatus of the second aspect, the detection mode is switched such that, when the print job is not being printed, the remaining ink amount detecting means controls the amount of ink remaining in the ink tank by the number of pixels corresponding to the amount of ink jetted from the ink jet recording head and detects the remaining ink amount when the number of pixels exceeds a predetermined number.

Namely, when the amount of ink remaining in the ink tank is relatively large, even if there is an error in the remaining ink amount, the possibility of the ink running out is low. Thus, the remaining ink amount is detected at high speed by calculating the jetted pixels. However, when the amount of ink remaining in the ink tank is relatively small, if there is an error in the remaining ink amount, the possibility of ink running out is high. Therefore, the remaining ink amount is accurately detected by detecting the amount of ink remaining in the ink tank directly. The structure for directly detecting the remaining ink amount is not particularly limited. For example, an optical sensor can be used in which the remaining ink amount is detected by irradiating light onto the level of the ink and measuring the time required for the light to be reflected back to the optical sensor.

By switching the detection mode in the above-described manner, the printing processing can be efficiently carried out. The predetermined number of pixels can be appropriately selected. It is advantageous if the predetermined number of pixels is set to a number of pixels which corresponds to the ink amount near the lower limit of the ink tank.

A seventh aspect of the present invention is an ink jet recording apparatus according to the second aspect, wherein the remaining ink amount detecting means detects the remaining ink amount again after ink has been supplied to the ink tank by the ink supply means in response to the empty signal outputted from the remaining ink amount detecting means, and, when the remaining ink amount detecting means outputs the empty signal again, the control means outputs a main tank empty signal indicating that the main tank is empty.

According to the seventh aspect, in the ink jet recording apparatus of the second aspect, the remaining ink amount detecting means detects the remaining ink amount after ink has been supplied to the ink tank. When the remaining ink amount detecting means outputs the empty signal again, it is determined that ink has not been supplied to the ink tank and that there is no ink in the main tank. With this structure, the amount of ink remaining in the main tank can be detected without using a sensor. Therefore, the apparatus as a whole can be produced at a low cost.

An eighth aspect of the present invention is an ink jet recording apparatus according to the second aspect, further comprising storage means for storing a number of pixels corresponding to the amount of ink jetted from the ink jet recording head, wherein the remaining ink amount detecting means detects the remaining ink amount again after ink has been supplied to the ink tank by the ink supply means in response to the empty signal outputted from the remaining ink amount detecting means, and, when the remaining ink amount detecting means outputs the empty signal again, the control means compares the number of pixels stored in the storage means with the number of pixels corresponding to the amount of ink filled in the main tank and outputs, when the numbers are the same or close to each other, a main tank empty signal indicating that the main tank is empty.

According to the eighth aspect, in the ink jet recording apparatus of the second aspect, after ink has been supplied to the ink tank, the remaining ink amount detecting means detects the amount of ink remaining in the ink tank. When the remaining ink amount detecting means outputs the empty signal again, it can be determined that ink has not been supplied to the ink tank or an ink flow path between the main tank and the ink tank is being interrupted for some reason. Accordingly, the control means compares the number of pixels stored in the storage means with the number of pixels corresponding to the amount of ink filled in the main tank (i.e. the amount of ink in the main tank before a print job). When the numbers are the same or close to each other, it is determined that ink has not been supplied to the ink tank, and that the main tank is empty. Then, the control means outputs a main tank empty signal indicating that the main tank is empty. The ink jet recording apparatus may also be structured such that, when the number of pixels stored in the storage means is significantly different from the number of pixels corresponding to the amount of ink filled in the main tank, it is determined that the ink flow path between the main tank and the ink tank is interrupted, and a warning is given.

With the above-described structure, the amount of ink in the main tank can be detected without using a sensor. Therefore, the apparatus as a whole can be produced at a low cost. Further, problems caused by interruption of the ink flow from the tank or the like can also be found.

In the seventh and eighth aspects, for example, in cases where an upper limit sensor is provided which outputs a signal when ink is not supplied to the ink tank to its upper limit, it can be determined that there is no ink in the main tank when the upper limit sensor outputs a signal after ink has been supplied to the ink tank. Alternatively, in cases where an upper limit sensor is provided which outputs a signal when ink which is supplied to the ink tank reaches its upper limit, it can be determined that there is no ink in the main tank when the upper limit sensor outputs no signal after ink has been supplied to the ink tank.

A ninth aspect of the present invention is an ink jet recording apparatus comprising: an ink jet recording head including an ink tank to which ink is supplied, the ink jet recording head printing by jetting the ink from the ink tank in accordance with image information in a print job; remaining ink amount detecting means for detecting the amount of ink remaining in the ink tank over a first time interval until the ink amount reaches a predetermined amount larger than a lower limit, and for detecting the ink amount over a second time interval, which is shorter than the first time interval, after the ink amount has reached the predetermined amount, and outputting an empty signal indicating shortage of ink when the ink amount is no more than the lower limit; and ink supply means including a main tank for storing ink, the ink supply means supplying ink from the main tank to the ink tank in response to the empty signal outputted from the remaining ink amount detecting means.

According to the ninth aspect, the remaining ink amount detecting means detects the amount of ink remaining in the ink tank over a first time interval until the remaining ink amount reaches a predetermined amount larger than a lower limit, and detects the remaining ink amount over a second time interval, which is shorter than the first time interval, after the remaining ink amount has reached the predetermined amount.

When the amount of ink remaining in the ink tank is frequently detected, accuracy of detection is improved, but this frequent detection wastes time. Therefore, in the ninth aspect, the amount of ink remaining in the ink tank is detected over a first time interval until the ink amount reaches a predetermined amount which is relatively large, and the remaining ink amount is detected over a second time interval, which is shorter than the first time interval, after the ink amount has reached the predetermined amount. In this way, the number of detection of the amount of ink in the ink tank is minimized.

As a result, the time required for stopping the operation of the apparatus for ink amount detection can be substantially decreased. Further, the amount of ink remaining in the ink tank can be detected immediately after the ink amount has reached the lower limit. The predetermined amount can be appropriately selected.

When a print job includes a large number of sheets, the amount of ink in the ink tank may become insufficient before printing of all the sheets is finished. Therefore, once a predetermined number of pixels is printed, the amount of ink remaining in the ink tank may be detected during a printing processing as well. In this case, the printing processing is interrupted by the detection. Thus, in the case of an ink jet recording apparatus which has ink tanks for multiple colors so that full-color images are formed, it is preferable to detect only the amount of ink in an ink tank for a specific color when the amount of ink used exceeds an amount corresponding to the predetermined number of pixels.

A tenth aspect of the present invention is an ink jet recording apparatus comprising: an ink jet recording head including an ink tank to which ink is supplied, the ink jet recording head printing by jetting the ink from the ink tank in accordance with image information in a print job; remaining ink amount detecting means for detecting the remaining ink amount for every predetermined number of printed pixels, which number of printed pixels is smaller than the number of pixels which can be printed after an empty signal indicating shortage of ink is outputted, and outputting the empty signal when the ink amount is no more than a lower limit; and ink supply means including a main tank for storing ink, the ink supply means supplying ink from the main tank to the ink tank in response to the empty signal outputted from the remaining ink amount detecting means.

The amount of ink remaining in the ink tank is detected when the ink amount reaches the lower limit. However, even after the remaining ink amount has reached the lower limit, some ink remains in the ink tank. According to the tenth aspect, the remaining ink amount detecting means detects the ink amount for every predetermined number of printed pixels, which predetermined number of printed pixels is smaller than the number of pixels which can be printed with the ink remaining in the ink tank after the remaining ink amount has reached the lower limit. In this way, a case in which ink in the ink tank runs out during printing so that further printing cannot be performed is prevented. The predetermined number of pixels for the ink amount detection is preferably set on the basis of the coverage area for the best quality. As a result, printing of files having a large coverage area can be ensured.

An eleventh aspect of the present invention is an ink jet recording apparatus comprising: an ink jet recording head including an ink tank to which ink is supplied, the ink jet recording head printing by jetting the ink from the ink tank in accordance with image information in a print job; remaining ink amount detecting means for controlling, when the print job is not being printed, the amount of ink remaining in the ink tank by a number of pixels corresponding to the amount of ink jetted from the ink jet recording head, and for detecting the remaining ink amount when the number of pixels exceeds a predetermined number, and outputting an empty signal indicating shortage of ink when the ink amount is no more than a lower limit; and ink supply means including a main tank for storing ink, the ink supply means supplying ink from the main tank to the ink tank in response to the empty signal outputted from the remaining ink amount detecting means.

When the amount of ink remaining in the ink tank is detected directly, the remaining ink amount can be more accurately detected as compared with cases in which the remaining ink amount is detected based on the number of pixels corresponding to the amount of ink jetted from the ink jet recording head. However, this direct detection takes time. Thus, according to the eleventh aspect, the detection mode is switched such that, the amount of ink remaining in the ink tank is initially detected based on the number of pixels corresponding to the amount of ink jetted from the ink jet recording head until the number of pixels jetted reaches a predetermined value, and then, after the number of pixels has reached the predetermined value, the amount of ink remaining in the ink tank is directly detected.

Namely, when the amount of ink remaining in the ink tank is relatively large, even if there is an error in the ink amount, the possibility of the ink running out is low. Thus, the ink amount is detected at high speed by calculating the jetted pixels. However, when the amount of ink remaining in the ink tank is relatively small, if there is an error in the remaining ink amount, ink may run out. Therefore, the remaining ink amount is accurately detected by detecting the amount of ink remaining in the ink tank directly. The structure for directly detecting the remaining ink amount is not particularly limited. For example, an optical sensor can be used in which the remaining ink amount is detected by irradiating light onto the level of the ink and measuring the time required for the light to be reflected back to the optical sensor.

By switching the detection mode in the above-described manner, the printing processing can be efficiently carried out. The predetermined number of pixels can be appropriately selected. It is advantageous if the predetermined number of pixels is set to a number of pixels which corresponds to the ink amount near the lower limit of the ink tank.

A twelfth aspect of the present invention is an ink jet recording apparatus comprising: an ink jet recording head including an ink tank to which ink is supplied, the ink jet recording head printing by jetting the ink from the ink tank in accordance with image information in a print job; remaining ink amount detecting means for detecting the amount of ink remaining in the ink tank at predetermined time intervals and after the ink is supplied, and outputting an empty signal indicating shortage of ink when the remaining ink amount is no more than a lower limit; ink supply means including a main tank for storing ink, the ink supply means supplying ink from the main tank to the ink tank in response to the empty signal outputted from the remaining ink amount detecting means; and control means which outputs a main tank empty signal indicating that the main tank is empty, when the remaining ink amount detecting means detects the ink amount remaining after ink supply and outputs the empty signal.

According to the twelfth aspect, the remaining ink amount detecting means detects the ink amount after ink has been supplied to the ink tank. When the remaining ink amount detecting means outputs the empty signal again, it is determined that ink has not been supplied to the ink tank and that there is no ink in the main tank. With this structure, the amount of ink in the main tank can be detected without using a sensor. Therefore, the apparatus as a whole can be produced at a low cost.

A thirteenth aspect of the present invention is an ink jet recording apparatus comprising: an ink jet recording head including an ink tank to which ink is supplied, the ink jet recording head printing by jetting the ink from the ink tank in accordance with image information in a print job; storage means for storing a number of pixels corresponding to the amount of ink jetted from the ink jet recording head; remaining ink amount detecting means for detecting the amount of ink remaining in the ink tank at predetermined time intervals and after ink supply, and outputting an empty signal indicating shortage of ink when the remaining ink amount is no more than a lower limit; and control means for comparing, when the remaining ink amount detecting means detects the remaining ink amount after the ink is supplied and outputs the empty signal, the number of pixels stored in the storage means with the number of pixels corresponding to the amount of ink filled in the main tank and outputting, when the numbers are the same or close to each other, a main tank empty signal indicating that the main tank is empty.

According to the thirteenth aspect, after ink has been supplied to the ink tank, the remaining ink amount detecting means detects the amount of ink remaining in the ink tank. When the remaining ink amount detecting means outputs the empty signal again, it can be determined that ink has not been supplied to the ink tank or an ink flow path between the main tank and the ink tank is being interrupted for some reason. Accordingly, the control means compares the number of pixels stored in the storage means with the number of pixels corresponding to the amount of ink filled in the main tank. When the numbers are the same or close to each other, it is determined that ink has not been supplied to the ink tank, and that the main tank is empty. Then, the control means outputs a main tank empty signal indicating that the main tank is empty. The ink jet recording apparatus may also be structured such that, when the number of pixels stored in the storage means is significantly different from the number of pixels corresponding to the amount of ink filled in the main tank (i.e. the amount of ink in the main tank before a print job), it is determined that the ink flow path between the main tank and the ink tank is interrupted, and a warning is given.

With the above-described structure, the amount of ink in the main tank can be detected without using a sensor. Therefore, the apparatus as a whole can be produced at a low cost. Further, problems caused by interruption of the ink flow from the tank or the like can also be found.

In the twelfth and thirteenth aspects, for example, in cases where an upper limit sensor is provided which outputs a signal when ink is not supplied to the ink tank to its upper limit, it can be determined that there is no ink in the main tank when the upper limit sensor outputs a signal after ink has been supplied to the ink tank. Alternatively, in cases where an upper limit sensor is provided which outputs a signal when ink which is supplied to the ink tank reaches its upper limit, it can be determined that there is no ink in the main tank when the upper limit sensor outputs no signal after ink has been supplied to the ink tank.

BRIEF DESCRIPTION OF THE DRAWINGS

FIG. 9A is a control routine for controlling ink supply when the power is on; and FIG. 9B is a control routine for controlling ink supply when the power is off.

DESCRIPTION OF THE PREFERRED EMBODIMENTS

First Embodiment

Figure 1:
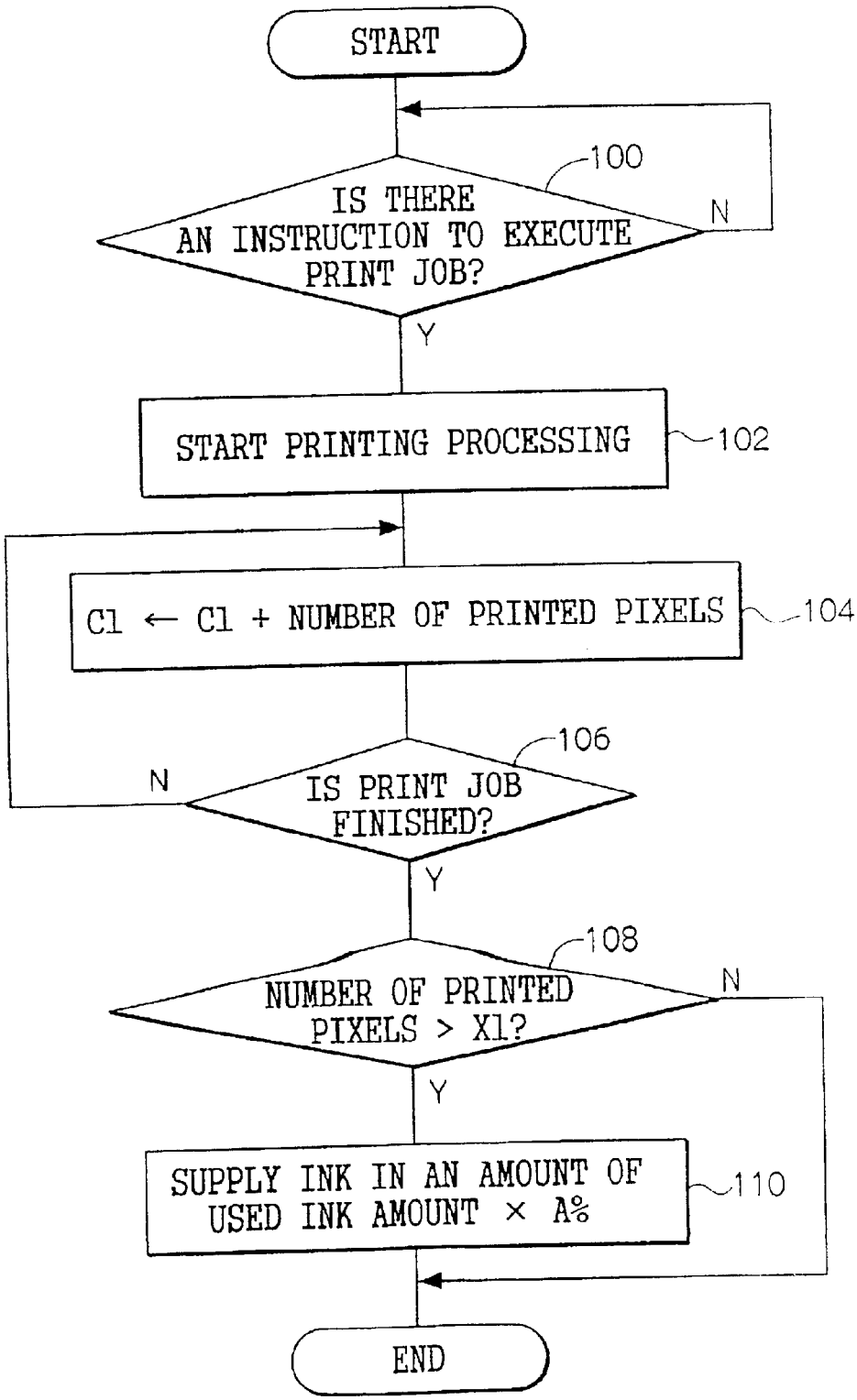
FIG. 1 is an ink supply control routine executed by a control component of an ink jet recording apparatus according to an embodiment of the present invention.

Referring now to the attached drawings, an ink jet recording apparatus 10 according to a first embodiment of the present invention will be hereinafter described in detail. As shown in FIGS. 2 to 6, the ink jet recording apparatus 10 according to the first embodiment has a main body 12 and a tray unit 14 disposed below the main body 12. The main body 12 and the tray unit 14 are disposed within a housing formed by an upper housing 16 and a lower housing 18. The upper housing 16 and the lower housing 18 may be integrally formed, or may be separately formed and then combined together. Further, a display 27 for displaying information is provided at the upper housing 16 and displays the processing state and the like of the ink jet recording apparatus 10.

Figure 2:
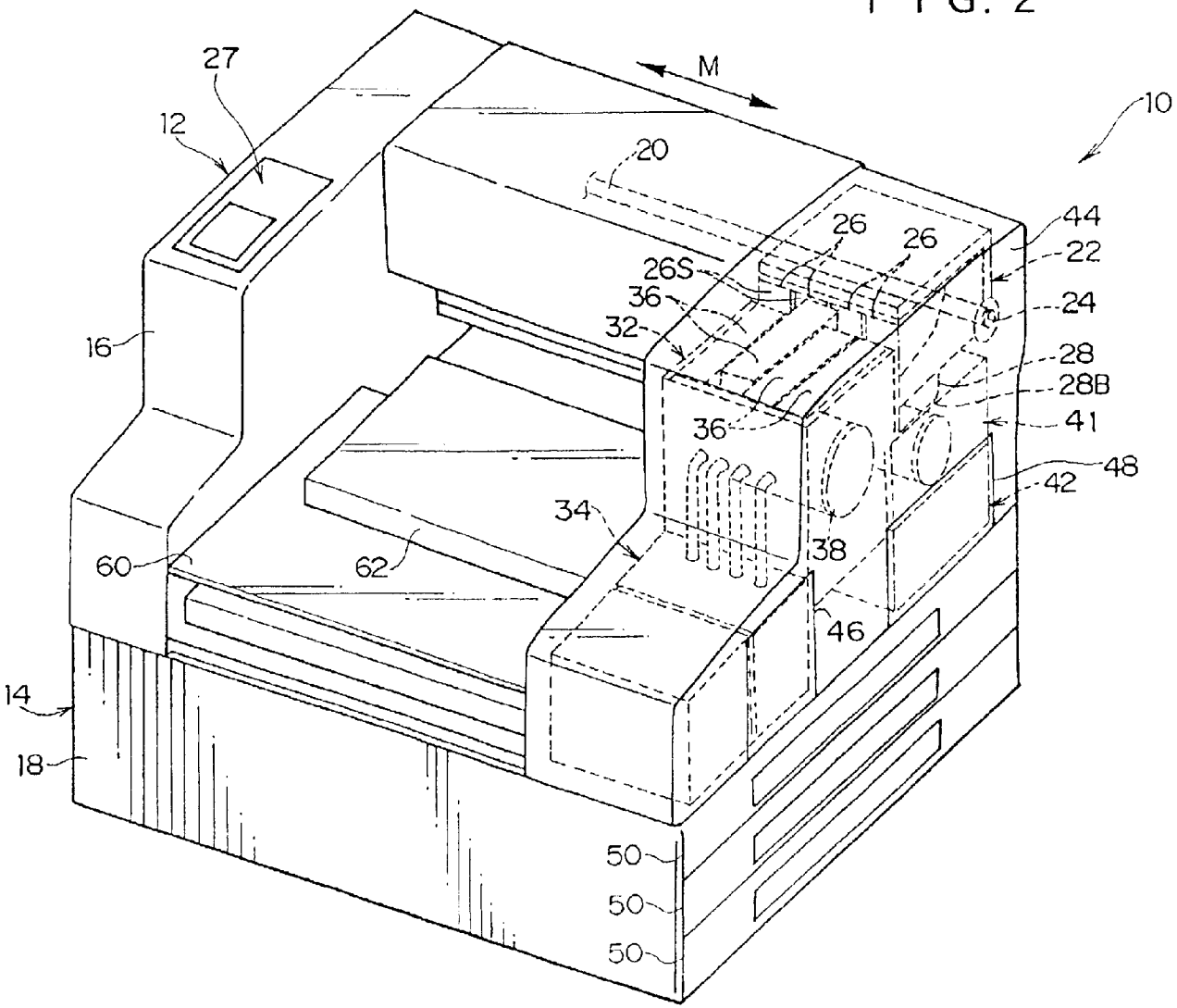
FIG. 2 is a perspective view of the ink jet recording apparatus according to the embodiment of the present invention.
Figure 4:
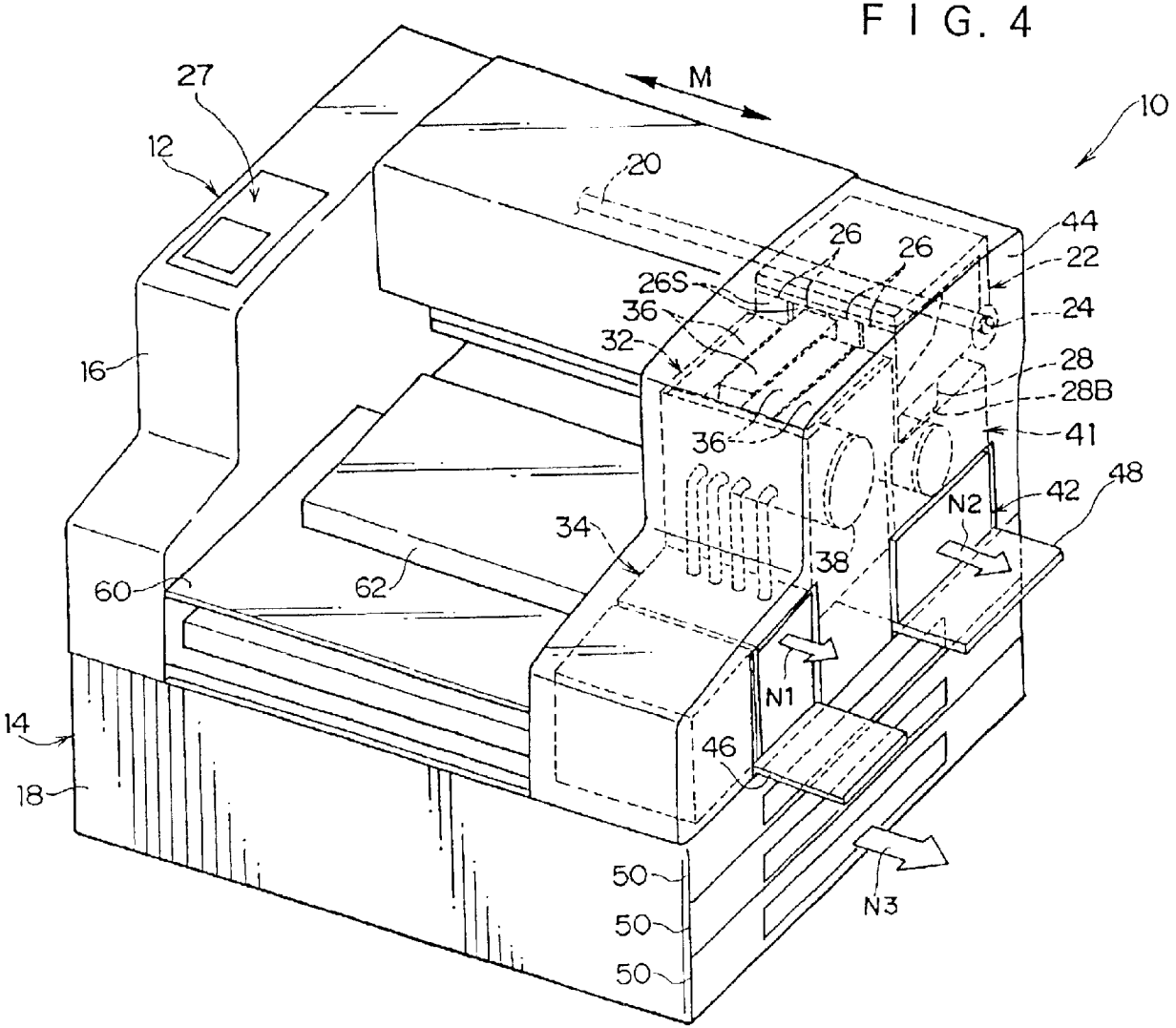
FIG. 4 is a perspective view of the ink jet recording apparatus according to the embodiment of the present invention.
Figure 5:
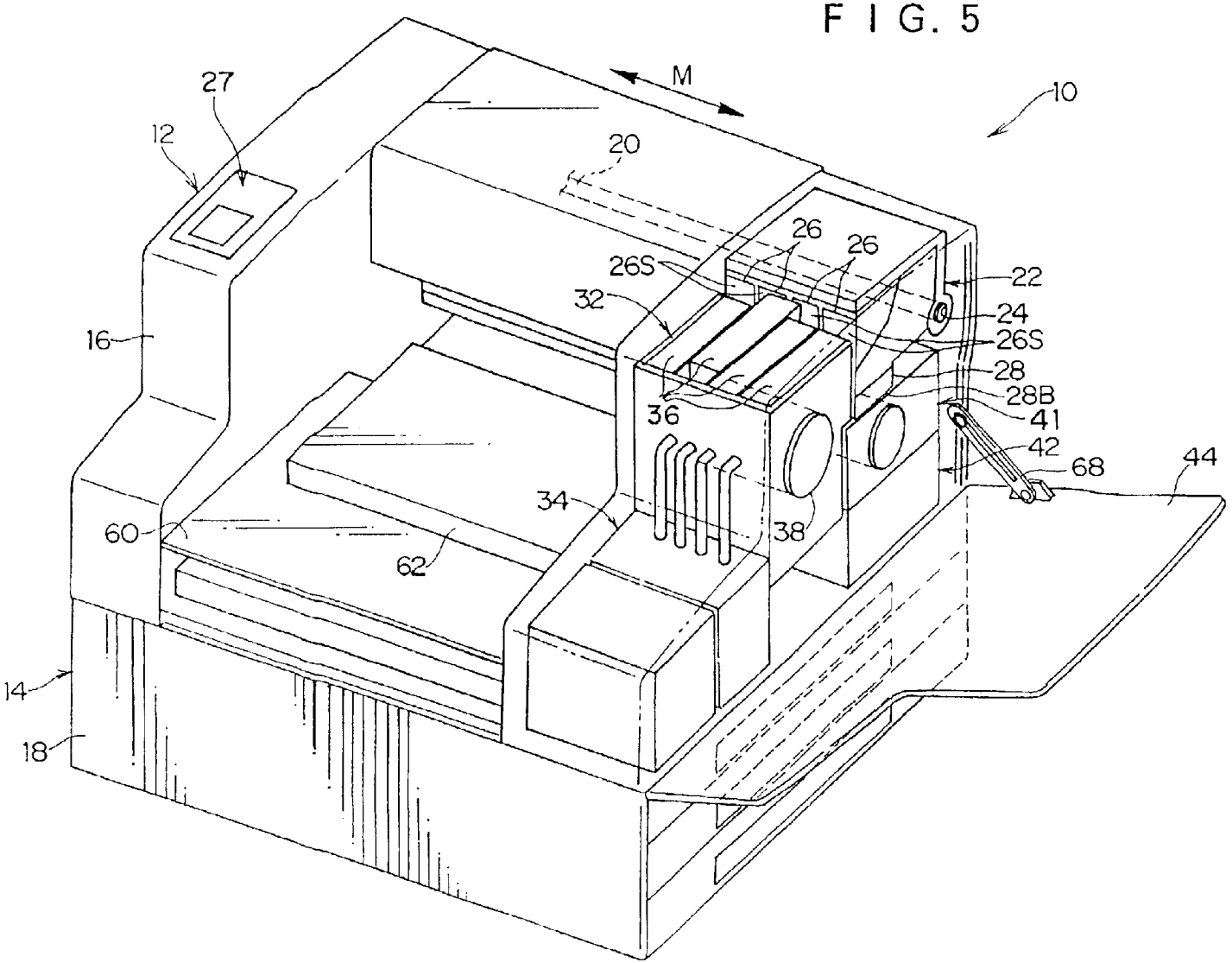
FIG. 5 is a perspective view of the ink jet recording apparatus according to the embodiment of the present invention.

A shaft 20 is disposed inside the main body 12, along the direction of arrow M in FIGS. 2, 4, and 5, so as to pass through an insertion hole 24 formed in a carriage 22. The carriage 22 is moved (for main scanning) by an unillustrated drive unit along a longitudinal direction of the shaft 20.

Sub-ink tanks 26 and recording heads 28 are mounted in the carriage 22. The recording head 28 jets ink stored in the sub-ink tank 26 onto a sheet material for recording 30 (see FIG. 3) in accordance with image information. The number of the sub-ink tanks 26 and the recording heads 28 is not particularly limited. A sub-ink tank 26 having ink of a particular color stored therein and the recording head 28 may be provided as a pair. In the present embodiment, however, four pairs of the sub-ink tank 26 and the recording head 28 for respective inks of black (K), cyan (C), magenta (M), and yellow (Y) are provided so that full-color images can be recorded. The sub-ink tank 26 corresponds to the ink tank of the present invention, and the recording head 28 corresponds to the ink jet recording head of the present invention.

Figure 7:
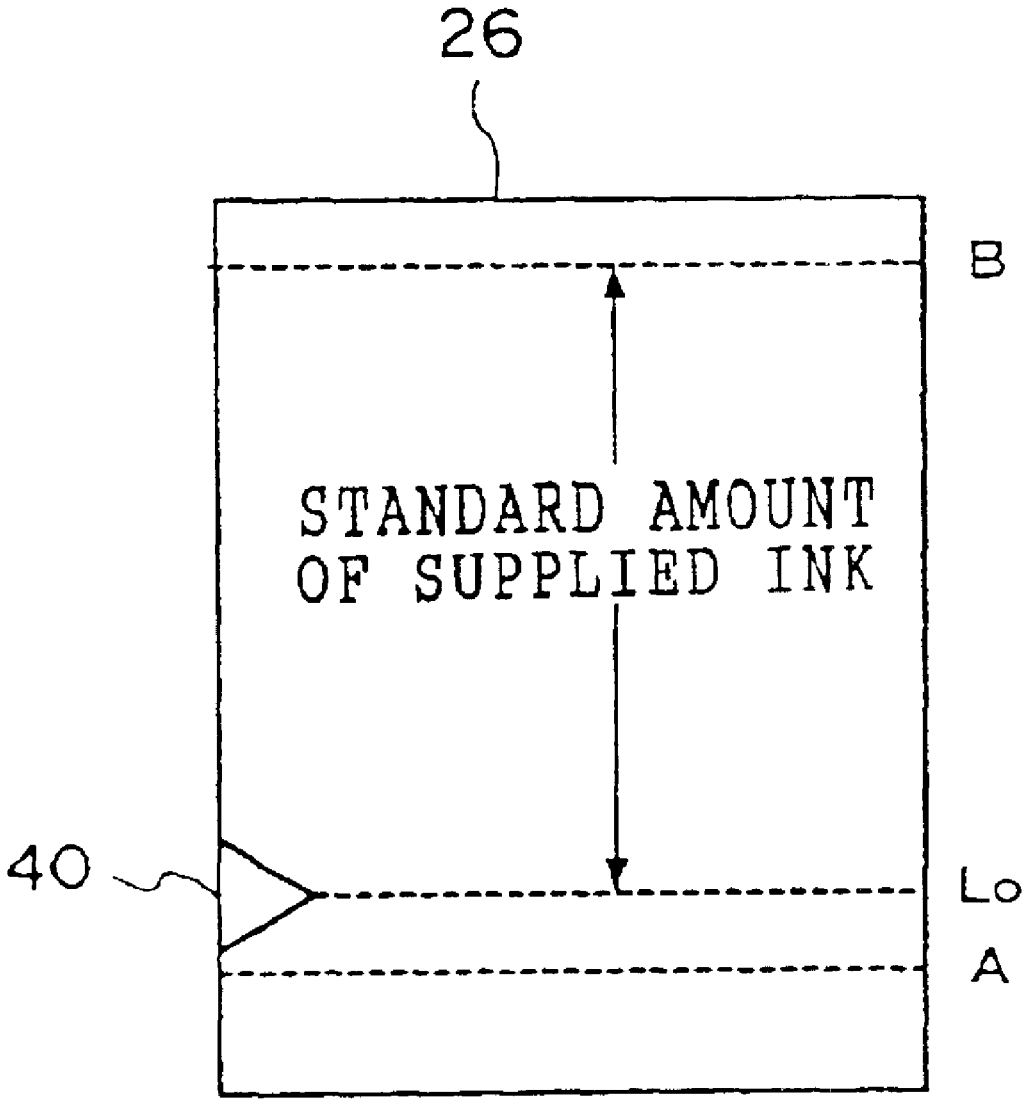
FIG. 7 is a schematic view of the inside of a sub tank.

Since the recording head 28 jets ink supplied from the sub-ink tank 26 as ink droplets, ink in the sub-ink tank 26 decreases as images are recorded. Therefore, as shown in FIG. 7, an ink amount sensor 40 is mounted to the sub-ink tank 26. The ink amount sensor 40 detects whether or not the remaining amount of ink inside the sub-ink tank 26 is equal to or less than a predetermined amount. The ink amount sensor 40 corresponds to a part of the remaining ink amount detecting means of the present invention.

For example, when the level of the ink in the sub-ink tank 26 is below or above a position at which the ink amount sensor 40 is mounted, namely, below or above a position of Lo (low level) shown in FIG. 7, the ink amount sensor 40 outputs a signal indicating the amount of ink in the sub-ink tank 26, such as a low-level or a high-level signal, to a control component 13 which will be described later. By the remaining ink amount signal, it is possible to learn whether the amount of ink in the sub-ink tank 26 is equal to or less than a predetermined amount.

Further, as shown in FIG. 2, an ink supply device 32 is mounted in the upper and lower housings 16 and 18. The ink supply device 32 has a plurality of ink supply units 36 (four in the present embodiment) for supplying ink to the corresponding sub-ink tanks 26. A pump 38 is provided at the ink supply device 32. The ink supply device 32 corresponds to the ink supply means of the present invention.

Ink is supplied to the sub-ink tank 26 in the following manner. First, while the carriage 22 is in an ink supplying position (i.e., the position shown in FIGS. 2, 4, and 5), the ink supply unit 36 advances toward a side surface 26S of the sub-ink tank 26 so as to be connected to the sub-ink tank 26. In this state, the pump 38 is driven, and ink is supplied from a main ink tank 34 via the ink supply unit 36 to the sub-ink tank 26. The main ink tank 34 contains ink having the same colors as the colors of the ink in the sub-ink tanks 26 to which ink is to be supplied.

The position of the carriage 22 where ink can be supplied to the sub-ink tank 26 may be the same as its home position or different therefrom. In the latter case, the ink supplying position and the home position may be detected by an unillustrated position sensor.

The main ink tank 34 is disposed under the ink supply device 32. Ink of each color to be used in the ink jet recording apparatus 10 is separately stored in the main ink tank 34. The ink of each color is supplied by the ink supply device 32 to the corresponding sub-ink tank 26. The main ink tank 34 corresponds to the ink tank of the present invention.

The main ink tank 34 is disposed so that the level of the ink stored in the main ink tank 34 is not above the surface (a bottom surface 28B) of the recording head 28 from which ink is jetted. Further, the main ink tank 34 is supported by an unillustrated supporting member so as to be slidingly movable from the upper housing 16 in a direction of arrow N1 shown in FIG. 4 (i.e., in the same direction as the direction in which the carriage 22 is moved).

A maintenance device 41 is provided below the carriage 22. The maintenance device 41 performs maintenance operations such as capping, dummy jetting, suction of excessive ink, and the like with respect to the bottom surface 28B of the recording head 28. By doing maintenance operations, problems such as drying of ink within nozzles and clogging of the nozzles of the recording head 28 can be solved, and the recording head 28 is constantly maintained in a state optimum for jetting of ink droplets. When the maintenance operations are carried out on the recording head 28 by the maintenance device 41, the position of the carriage 22 (i.e., the maintenance position) is the same as the ink supplying position.

A tank for discharged ink 42 is provided below the maintenance device 41. Ink discharged by the maintenance operation performed by the maintenance device 41 (i.e., discharged ink) is stored in the tank for discharged ink 42. Moreover, the tank for discharged ink 42 has a size and a shape substantially the same as those of the maintenance device 41, and thus does not extend further toward the outside than the maintenance device 41 when the ink jet recording apparatus 10 is seen in plan view (i.e., seen from above). Further, in the same way as for the main ink tank 34, the tank for discharged ink 42 is supported by an unillustrated supporting member so as to be slidingly movable from the upper housing 16 in a direction of arrow N2 shown in FIG. 4 (i.e., in the same direction as the direction in which the carriage 22 is moved).

A discharged ink amount sensor (not shown) is provided at the discharge ink tank 42 and detects the amount of discharged ink stored therein. When the amount of discharged ink in the tank for discharged ink 42 reaches a predetermined amount, the discharged ink amount sensor transmits this information to the control component 13, which will be described later.

The upper housing 16 has a front panel 44 at a side where the aforementioned ink supply device 32, main ink tank 34, maintenance device 41, and tank for discharged ink 42 are located. The front panel 44 is supported by a shaft so as to be rotatable relative to the upper housing 16. As shown in FIG. 5, by rotating the front panel 44, the upper housing 16 can be opened from the front side, namely, in a direction which is the same as the direction in which the carriage 22 is moved.

An arm 68 extends from the front panel 44 to the upper housing 16 so as to limit the rotation of the front panel 44 to a predetermined range.

Further, as shown in FIGS. 2 and 4, doors 46 and 48 are formed at the front panel 44 at positions corresponding to the main ink tank 34 and the tank for discharged ink 42, respectively. Even when the front panel 44 is closed, the doors 46 or 48 can be opened so that the corresponding main ink tank 34 or tank for discharged ink 42 can be taken out.

The tray unit 14 is disposed inside the lower housing 18 and includes a plurality of trays 50 stacked in a vertical direction. Each of the trays 50 is formed in a substantially box-shape, and can accommodate sheet materials for recording 30 of specified sizes or sheet materials for recording 30 of the same size. The inkjet recording apparatus 10 on the whole can accommodate sheet materials for recording 30 of various sizes.

A plurality of sheet materials for recording 30 can be loaded in each of the trays 50. Furthermore, as indicated by arrow N3 in FIG. 4, each tray 50 can be slid in a direction which is the same as the direction in which the front panel 44 is opened (i.e., a direction which is the same as the direction in which the carriage 22 is moved) and pulled out from the lower housing 18 horizontally.

The sheet material for recording 30 on which an image is recorded by the ink jet recording apparatus 10 according to the present embodiment is not particularly limited so long as ink droplets jetted from the recording head 28 can adhere thereto. In addition to the sheet materials for recording which are conventionally used, OHP sheets and the equivalent can also be used as the sheet materials for recording 30.

Figure 3:
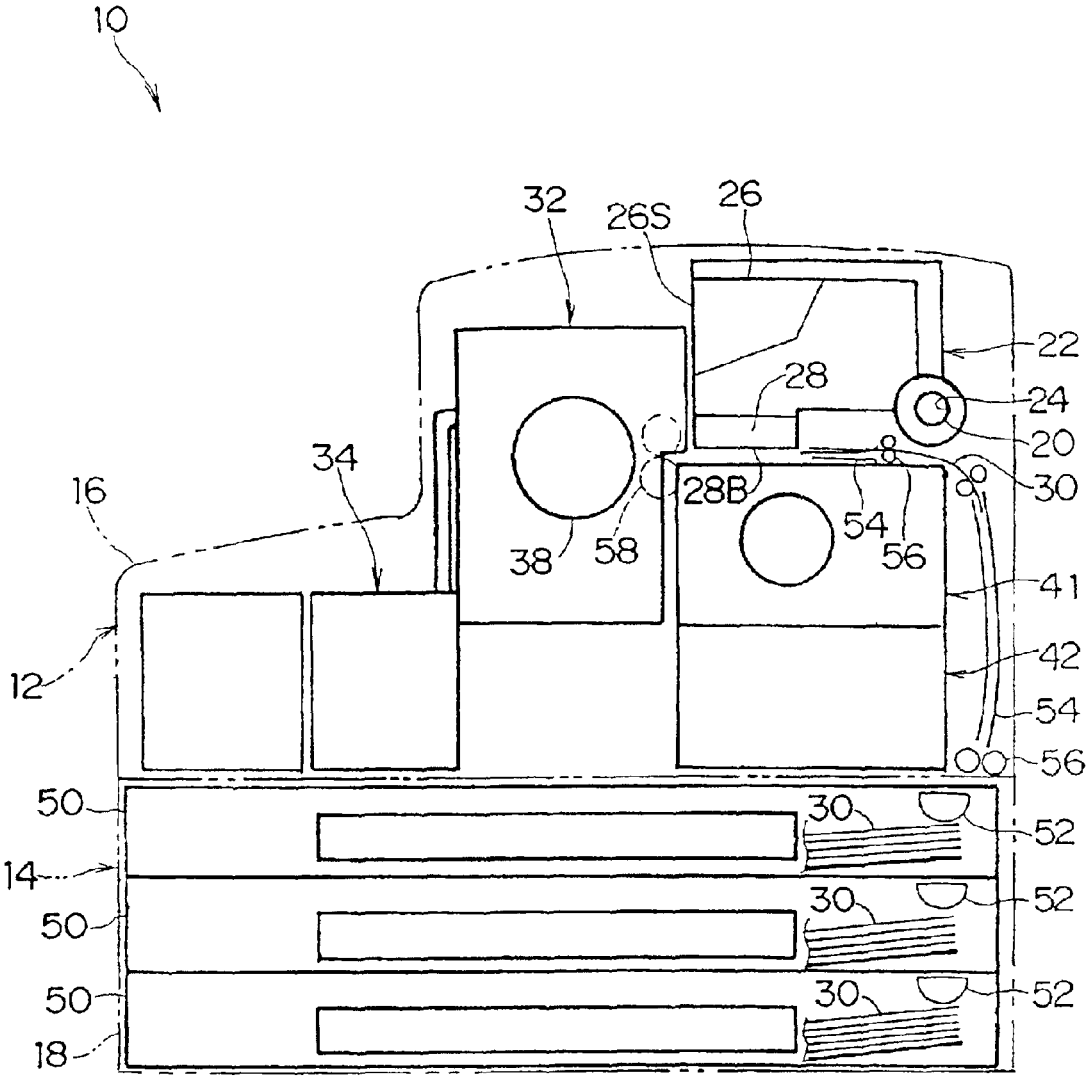
FIG. 3 is a schematic plan view showing the internal structure of the ink jet recording apparatus according to the embodiment of the present invention.

As shown in FIG. 3, a feed roller 52 is provided at each of the trays 20 so as to take up and send out, one by one, the sheet materials for recording 30 loaded in the tray 20. Guide plates 54 and transferring rollers 56 are provided inside the upper housing 16. The guide plates 54 guide the sheet material for recording 30, which has been sent out from the tray 20, to a position where images are recorded by the recording head 28. The transferring rollers 56 transfer the sheet material for recording 30 along the guide plates 54. Thus, the sheet material for recording 30 is transferred by the transferring rollers 56 while being guided by the guide plates 54. The carriage 22 is moved so that the recording head 28 carries out main scanning while jetting ink droplets. Further, the sheet material for recording 30 is transferred by the transferring rollers 56 and subjected to sub-scanning. In this way, a desired image is formed on the sheet material for recording 30. The sheet material for recording 30 having an image recorded thereon is further transferred by output rollers 58 and discharged onto an output tray 62 provided at the upper housing 16.

A sub-tray 60 is provided between the lower housing 18 and the output tray 62 so as to be detachable from the upper housing 16. Feed rollers (not shown) which are the same as those provided at the trays 50 are provided at the sub-tray 60 as well and can send out the sheet materials for recording 30 loaded in the tray 60.

Figure 6:
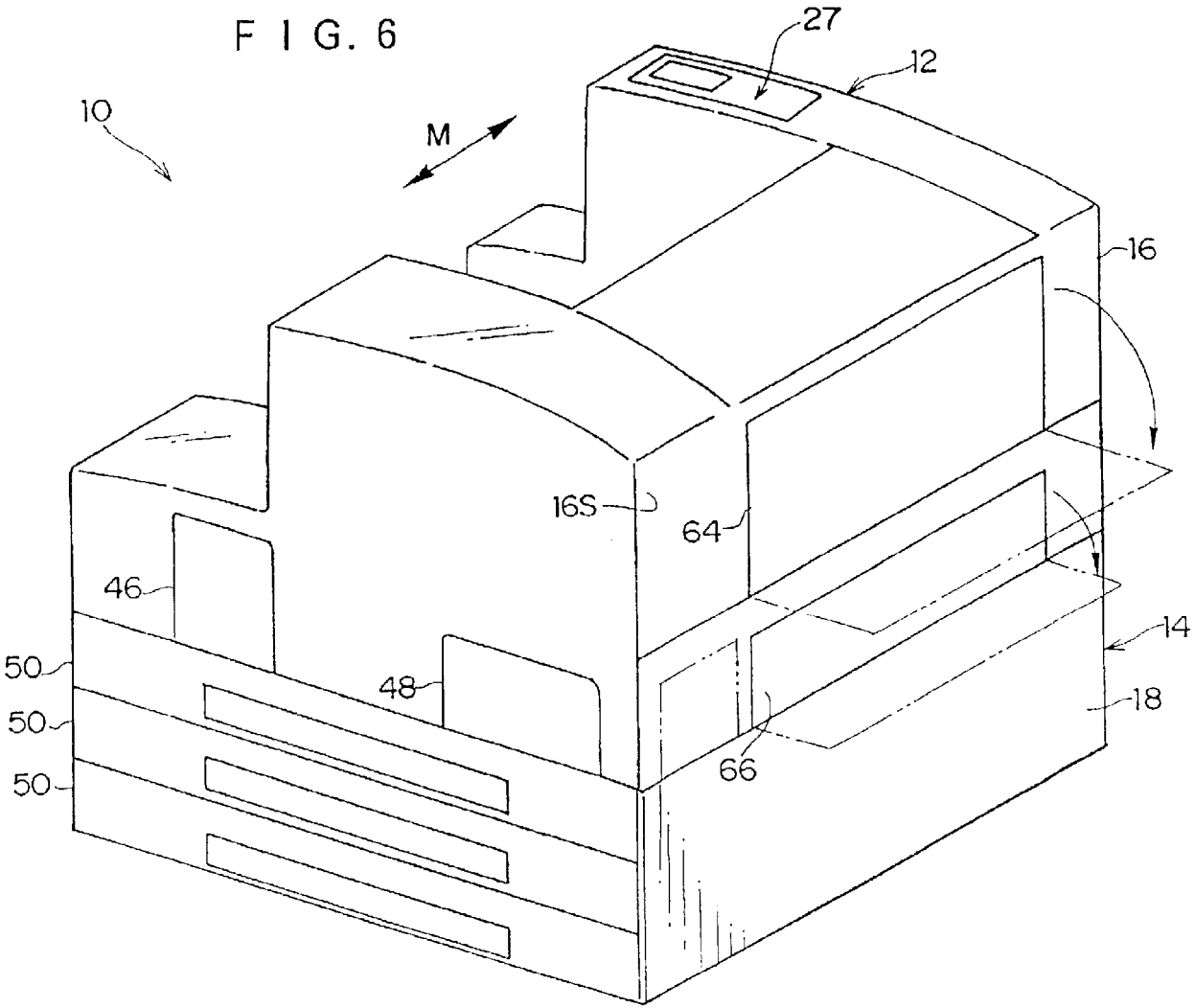
FIG. 6 is a perspective view of the ink jet recording apparatus according to the embodiment of the present invention.

As shown in FIG. 6, a panel for removal 64 is provided at a side surface 16S of the upper housing 16. When a paper jam is caused within the main body 12, the panel for removal 64 removes jammed paper. The panel for removal 64 is supported by a shaft so as to be rotatable relative to the upper housing 16, and is rotated as shown in FIG. 6 by a line with a long dash alternating with two short dashes so that the upper housing 16 is partially opened. In this way, jammed paper can be removed from the main body 12.

Moreover, a manual paper feed tray 66 is provided at the upper housing 16 below the panel for removal 64. In the same way as for the panel for removal 64, the manual paper feed tray 66 is also supported by a shaft so as to be rotatable relative to the upper housing 16. By rotating the manual paper feed tray 66 to a position shown in FIG. 6 by a line with a long dash alternating with two short dashes, the sheet material for recording 30 can be placed on the manual paper feed tray 66.

The aforementioned carriage 22, recording head 28, ink supply device 32, and maintenance device 41 are controlled by the control component 13 which will be described hereinafter.

Figure 8:
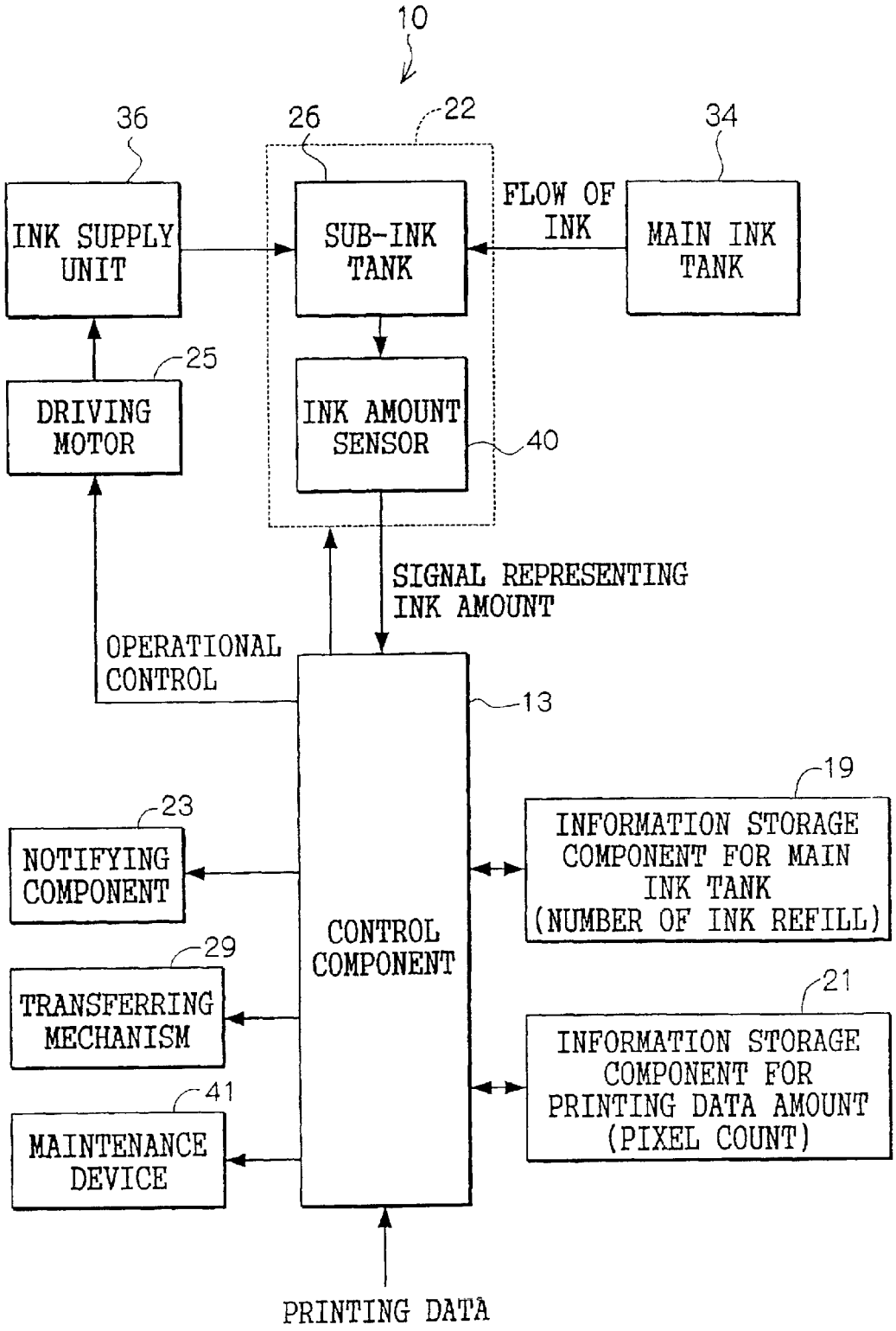
FIG. 8 is a schematic block diagram of the ink jet recording apparatus.

A functional block diagram of the ink jet recording apparatus 10 is shown in FIG. 8. The ink jet recording apparatus 10 in the present embodiment includes the control component 13 which controls the entire apparatus. A transferring mechanism 29 which includes the transferring rollers 56 and transfers the sheet material for recording 30 by controlling the driving of the transferring rollers 56, the carriage 22, the maintenance device 41, a driving motor 25 which drives the pump 38, an information storage component for the main ink tank 19, an information storage component for the printing data amount 21, and a notifying component 23 are connected to the control component 13.

The control component 13 is formed by a CPU (not shown) and corresponds to the control means of the present invention. Further, the information storage component for the main ink tank 19 and the information storage component for the printing data amount 21 are formed by a RAM (not shown), which is volatile memory, and correspond to the storage means of the present invention. The CPU, the RAM, the transferring mechanism 29, the notifying component 23, the driving motor 25, the ink amount sensor 40, and the maintenance device 41 are connected to each other via buses.

The information storage component for the main ink tank 19 stores data relating to ink supply such as the number of ink refill processings and the standard amount of ink supplied, which will be described later. The information storage component for the printing data amount 21 stores data relating to the amount of printing data such as the pixel count and the amount of ink per pixel, which will be described later.

The control component 13 controls the carriage 22 and the transferring mechanism 29 in accordance with inputted printing data so that the sheet material for recording 30 is printed. Further, ink supply is controlled based on the amount of printing data and a signal from the ink amount sensor 40, which signal indicates the amount of ink in the sub-ink tank 26. Details of the ink supply control will be described later.

The notifying component 23 is connected to the display 27 via an unillustrated bus. The notifying component 23 outputs data on the state of various processings such as the on/off state of the power supply, notification of the empty state of the main ink tank 34 and shortage of ink in the sub-ink tank 26, and an ink supply processing for the sub-ink tank 26. The display 27 then displays the data.

Next, referring to the flow charts in FIGS. 1 and 9 to 12, control routines executed by the control component 13 will be described as the operation of the present embodiment. Each step in the control routines is executed for ink of each color.

In a control routine shown in FIG. 1, first, when execution of a print job is instructed in step 100, the routine proceeds to step 102 where a printing processing for the print job is started. The printing processing for the print job is carried out by the control component 13. Namely, the control component 13 controls the ink jetting state of the recording head 28 such that ink droplets are jetted from the recording head 28 in accordance with printing data which is based on image information inputted to the control component 13. Further, by the control component 13 controlling so that the carriage 22 and the sheet material for recording 30 are moved in a main scanning direction and a sub-scanning direction, respectively, an image is formed on the sheet material for recording 30 by ink droplets. At this time, a pixel count C1 corresponding to the number of the jetted ink droplets is stored in the information storage component for the printing data amount 21.

Moreover, when maintenance of the recording head 28 becomes necessary, the control component 13 moves the carriage 22 to its home position and causes the maintenance device 41 to move close to the recording head 28 so that a predetermined maintenance operation is performed. By this maintenance operation, the recording head 28 recovers to its optimum state for ink jetting, and as a result, the optimum state for ink jetting is constantly maintained. Therefore, images of good quality can be constantly recorded.

Once the printing processing described above is started in step 102, the routine proceeds to step 104 where the number of pixels corresponding to the amount of ink actually jetted from the ink jet recording head 28 is added to the current pixel count C1. The pixel count C1 is initialized to 0 in advance.

In a subsequent step 106, a determination is made whether or not the print job is finished. If the print job is not finished, the routine returns to step 104, and the number of pixels corresponding to the amount of ink actually jetted from the ink jet recording head 28 is added to the current pixel count C1. In this way, until the print job is finished, the pixel count C1 is incremented by the number of pixels corresponding to the amount of ink jetted from the ink jet recording head 28.

When it is determined in step 106 that the print job is finished, the routine proceeds to step 108 where it is determined whether or not the pixel count C1 exceeds a predetermined number of pixels X1. When the determination is negative, the routine ends. The predetermined number of pixels X1 is the number of pixels corresponding to a predetermined amount of ink used, and this ink amount can be set by a user. The amount of ink used is preferably an amount of ink which can be supplied to the sub-ink tank 26 during the loss time between print jobs. This amount may be set in advance when the ink jet recording apparatus is manufactured.

For example, by setting the number of pixels X1 so that ink is supplied to the sub-ink tank 26 when ink is decreased by about 2 cc or more due to the printing processing for the print job, time required for supplying a specified amount of ink can be significantly reduced as compared with the time required for supplying a specified amount of ink after shortage of ink in the sub-ink tank 26 has been detected (i.e., ink refill processing). Thus, when the print job is finished, until a subsequent print job is executed, ink can be supplied to the sub-ink tank 26 to its upper limit.

When it is determined in step 108 that the pixel count C1 exceeds the predetermined number of pixels X1, the routine proceeds to 110 where the ink supply unit 36 is controlled so as to supply ink to the sub-ink tank 26 in an amount of a predetermined percentage A (%) of the used ink amount corresponding to the pixel count C1. When the ink supply operation is finished, the routine ends.

The amount of ink jetted from the ink jet recording head 28 is not always constant and somewhat varies according to various factors such as the environment in which the ink jet recording apparatus is disposed, the temperature, and the like. Therefore, the ink amount corresponding to the pixel count C1 does not always correspond with the amount of ink actually used.

For this reason, when a sensor for detecting the upper limit of ink is provided within the sub-ink tank 26, ink can be supplied to the sub-ink tank 26 so that the amount of ink therein becomes equal to the upper limit. However, provision of a sensor is expensive. Accordingly, in the present embodiment, the ink supply unit 36 is controlled so as to supply ink to the sub-ink tank 26 in an amount of a predetermined percentage A (%) of the ink amount corresponding to the pixel count C1.

In this way, ink in an amount close to the amount of ink used is always supplied to the sub-ink tank 26. Further, since the amount of ink supplied to the sub-ink tank 26 does not exceed the upper limit, problems such as oversupply of ink can be prevented. When ink supply is repeated in this manner, the amount of ink in the sub-ink tank 26 becomes insufficient, and shortage of ink in the sub-ink tank 26 is eventually detected. However, the time elapsed until a shortage of ink in the sub-ink tank 26 is detected is longer than that in the case in which ink is not supplied at all. Therefore, the number of ink refill processings performed can be reduced, and standby time of the ink jet recording apparatus caused by the ink refill processings can be reduced.

The predetermined percentage A (%) can be appropriately selected. The predetermined percentage A is preferably set so as to be near the ink amount corresponding to the pixel count C1, for example, 60% to 95%.

In the above description, ink is supplied after a print job has been finished. However, ink may be supplied before a print job is started.

Figure 9A:
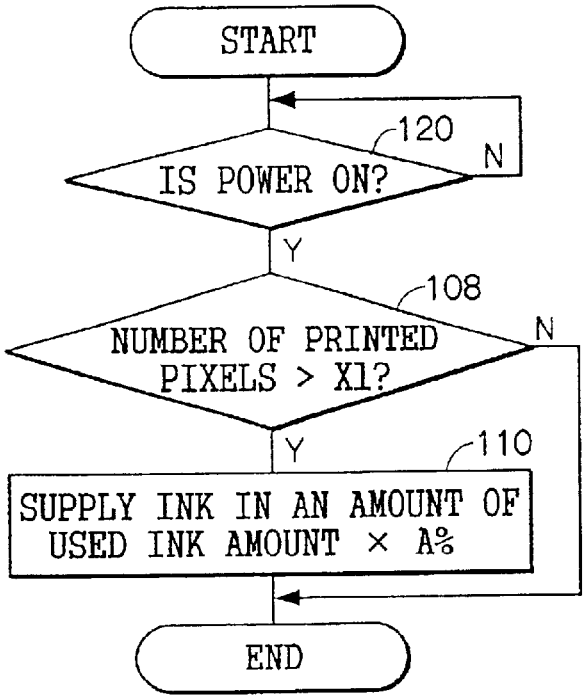
FIGS. 9A and 9B are control routines executed by a control component.
Figure 9B:
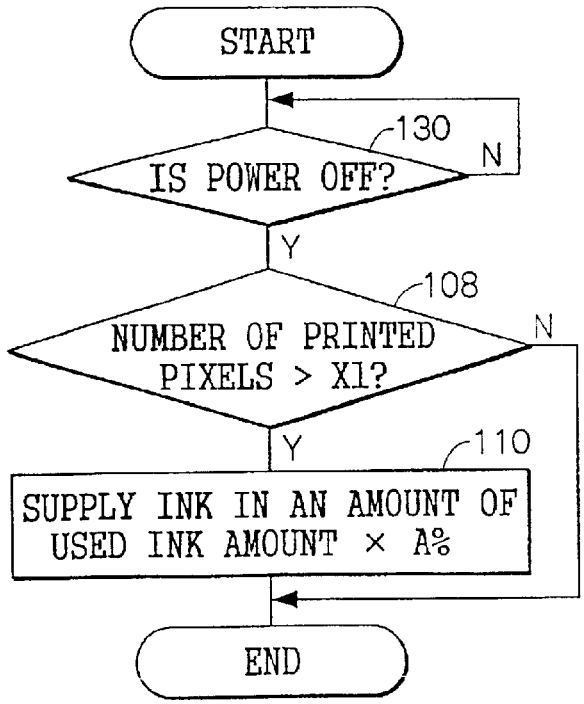

Further, the control component 13 may execute a control routine shown in FIG. 9A or 9B. In FIG. 9A, when it is determined in step 120 that the power is on, the routine proceeds to step 108 where it is determined whether or not the pixel count C1 exceeds a predetermined number of pixels X1. When the determination in step 108 is affirmative, the routine proceeds to step 110 where the ink supply unit 36 is controlled so as to supply ink to the sub-ink tank 26 in an amount of a predetermined percentage A (%) of the ink amount corresponding to the pixel count C1. In FIG. 9B, when it is determined in step 130 that the power is off, the routine proceeds to step 108 where a determination is made whether or not the pixel count C1 exceeds a predetermined number of pixels X1. When the determination in step 108 is affirmative, the routine proceeds to step 110 where the ink supply unit 36 is controlled so as to supply ink to the sub-ink tank 26 in an amount of a predetermined percentage A (%) of the ink amount corresponding to the pixel count. In addition, the ink supply unit 36 may be controlled so as to supply ink to the sub-ink tank 26 in the case in which the amount of ink consumed by printing exceeds a predetermined value when the sheet materials for recording 30 are loaded in the tray 50 or the operation mode of the ink jet recording apparatus is switched to sleep mode, namely, when the ink jet recording apparatus is in a standby state for a predetermined period of time and then set in a power-saving state.

When the power is turned on or off, the sheet materials for recording 30 are loaded in the tray 50, or when the operation mode of the ink jet recording apparatus is set to sleep mode, since there are no limitations on time, ink may be constantly supplied to the sub-ink tank 26 in an amount corresponding to the amount of ink used, i.e., the pixel count C1. A timing means may also be provided at the ink jet recording apparatus so that ink is constantly supplied to the sub-ink tank 26 during a period of time such as lunch break, when few people use the ink jet recording apparatus. Alternatively, the period of time when few printing operations are performed may be automatically detected based on statistical data, and ink may be constantly supplied in an amount corresponding to the amount of ink used, i.e., the pixel count C1, during the detected period of time.

With any of the above-described structures, the time period in which ink is supplied to the sub-ink tank 26 to its upper limit, the amount of ink in the sub-ink tank 26 becomes insufficient, and the ink shortage is detected by the ink amount sensor 40 can be made long. Therefore, the number of ink refill processings can be reduced. As a result, the probability of an ink supply operation being performed during printing becomes significantly low. Accordingly, it is possible to prevent a user from wasting his/her time waiting for an ink refill processing to be finished, and throughput is substantially improved.

Figure 10A:
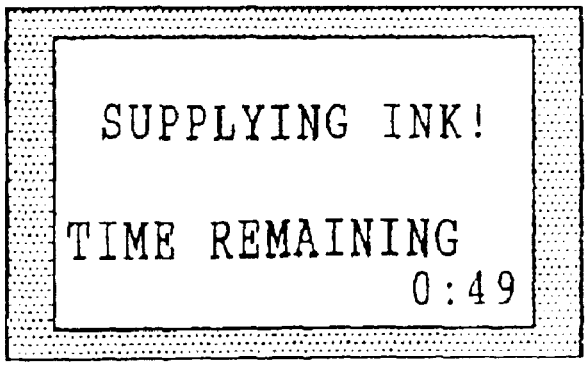
FIG. 10A is an example of a display which displays that an ink refill processing is in progress and a numerical value indicating the time remaining until the end of the processing.
Figure 10B:
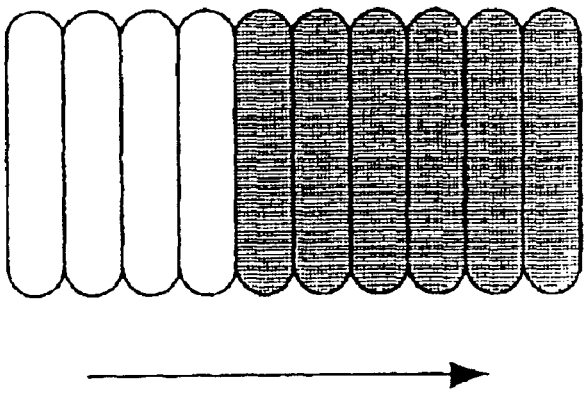
FIG. 10B is another example of the display indicating the time remaining until the end of the ink refill processing.

Moreover, during the ink refill processing, for example, a message that the ink refill processing is being performed and the time required till the end of the processing are displayed on the display 27 as shown in FIG. 10A, or the state of the ink amount is displayed as shown in FIG. 10B. Thus, a user can easily recognize that the ink refill processing is carried out by the ink jet recording apparatus 10. As a result, it is possible to prevent problems caused by user's mistakes, such as getting the wrong idea that the ink jet recording apparatus has broken down or forcibly turning the power off to stop the operation of the apparatus.

Further, in the ink jet recording apparatus 10 of the present first embodiment, the amount of ink within the main ink tank 34 is detected after the ink refill processing by fetching a signal outputted from the ink amount sensor 40, which signal indicates the amount of ink in the sub-ink tank 26. (This signal is hereinafter referred to as an "ink amount signal".)

Figure 11:
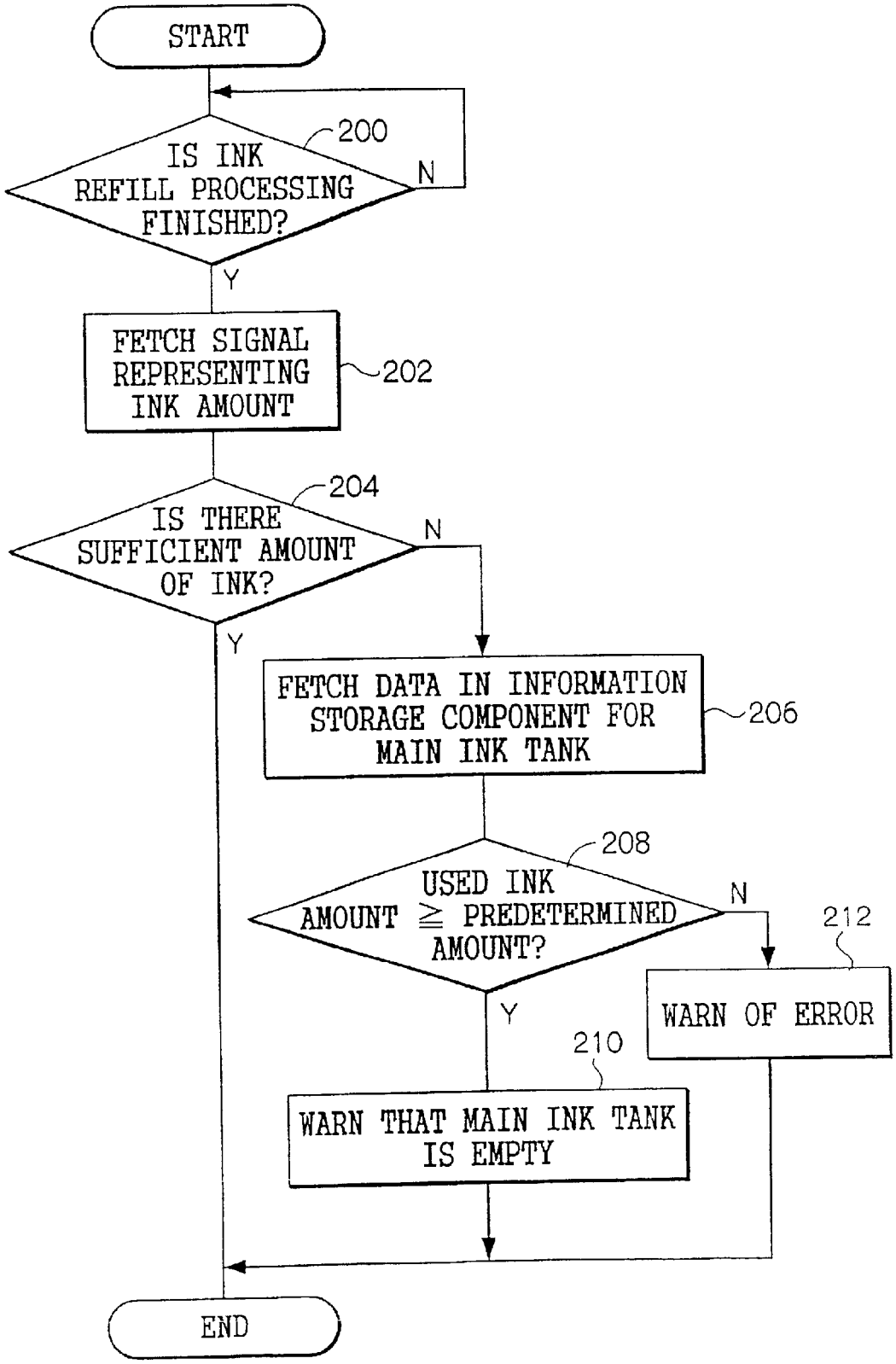
FIG. 11 is a control routine executed by the control component when the amount of ink in a main ink tank is detected.

Namely, as shown in FIG. 11, when it is determined in step 200 that the ink refill processing is finished, the routine proceeds to step 202 where an ink amount signal is fetched from the ink amount sensor 40. When the ink amount signal is a high-level signal, this means that a sufficient amount of ink is in the sub-ink tank 26, and it can be determined that ink has been supplied from the main tank 34. Therefore, when it is determined that a sufficient amount of ink is in the sub-ink tank 26, the routine ends.

When it is determined in step 204 that the ink amount signal is a low-level signal, this means that the amount of ink in the sub-ink tank 26 is insufficient and ink has not been supplied to the sub-ink tank 26. It is considered that the main ink tank 34 is empty or the main ink tank 34 is disconnected from the ink jet recording apparatus 10 for some reason.

Accordingly, the routine proceeds to step 206 where data on ink supply such as the number of ink refill processings performed and the standard supply amount are fetched from the information storage component for the main ink tank 19. In subsequent step 208, it is determined whether or not the amount of ink used for recording based on the fetched data on the ink supply is equal to or more than a predetermined ink amount. The predetermined ink amount corresponds to the maximum capacity of the main ink tank 34. When the amount of ink used for recording is equal to or more than the predetermined amount of ink, it can be deduced that the ink within the main ink tank 34 has been used up.

When the determination in step 208 is affirmative, it is determined that the main ink tank 34 is empty. Thus, the routine proceeds to step 210 where a warning is given by displaying on the display 27 a message that the main ink tank 34 is empty or by sounding a buzzer. Subsequently, the routine ends. When the determination in step 208 is negative, it is determined that ink is not supplied to the sub-ink tank 26 regardless of the fact that the main ink tank 34 still has some ink therein. It is highly possible that a problem such as disconnection of the main ink tank 34 from the main body 12 is caused. Therefore, an error warning is given on the display 27 or by sounding a buzzer. Subsequently, the routine ends.

Moreover, the following processing is also possible. When the ink amount signal is a low-level signal in the previous step 204, it is determined that there is no ink in the main ink tank 34. The routine then proceeds to step 210 where a warning is given by displaying on the display 27 a message that the main ink tank 34 is empty or by sounding a buzzer. Subsequently, the routine ends.

With such a structure, the amount of ink in the main ink tank 34 can be detected without a sensor being provided at the main ink tank 34. Further, it is also possible to detect problems such as disconnection of the main ink tank 34 from the ink jet recording apparatus 10.

Second Embodiment

Since an ink jet recording apparatus according to a second embodiment is similar to the ink jet recording apparatus 10 according to the first embodiment, only points different therefrom will be described. In the ink jet recording apparatus according to the second embodiment, the amount of ink in the sub-ink tank 26 for each color is detected by outputting signals from the ink amount sensor 40 when a print job is not carried out. The time in which a print job is not carried out is the time for non-printing operations such as turning on/off of the power, loading of the sheet materials for recording 30 in the tray 50, switching of the operation mode of the ink jet recording apparatus to sleep mode, and the like. When it is determined that a low-level signal is outputted from the ink amount sensor 40, the ink refill processing is immediately performed.

Figure 12:
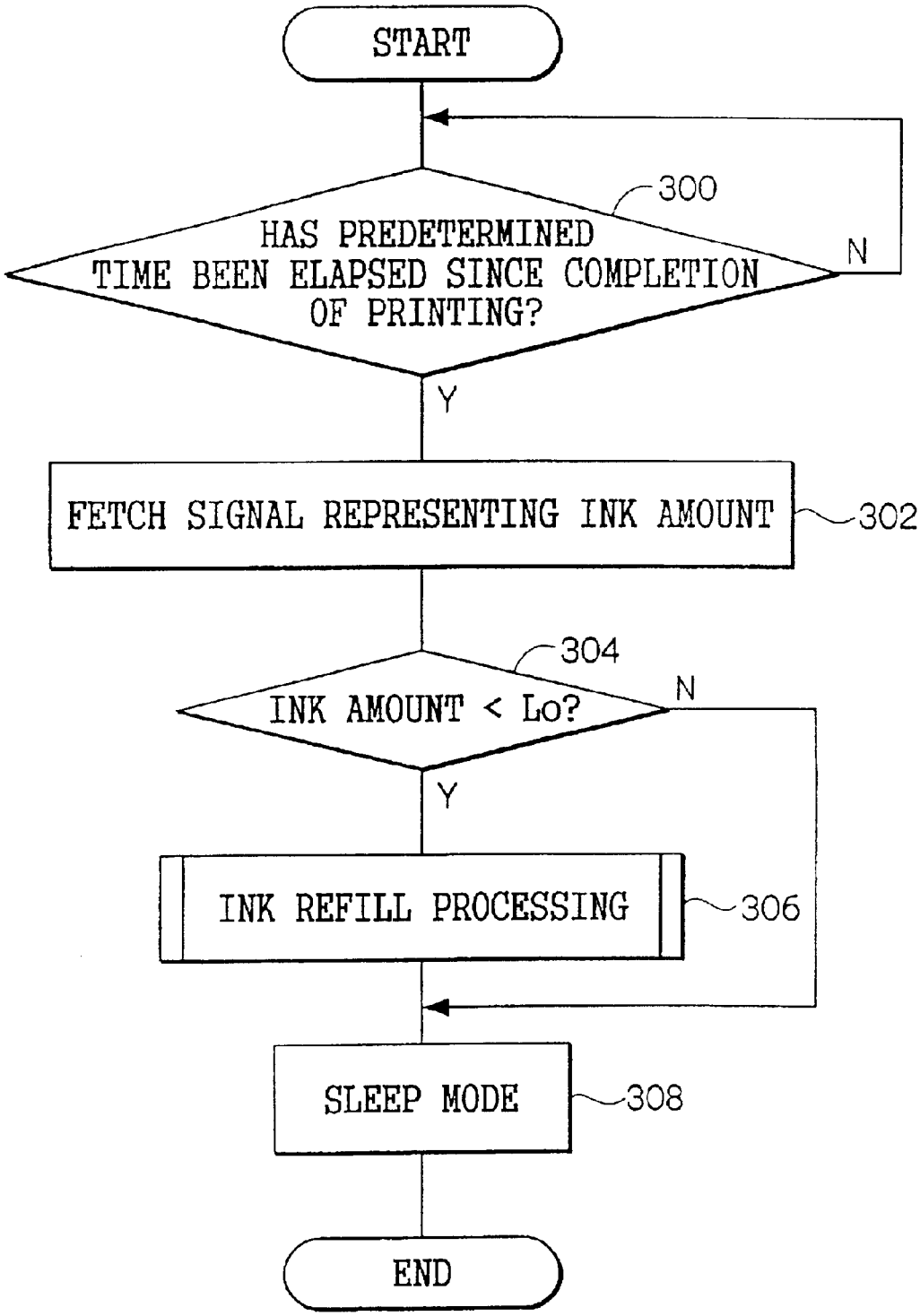
FIG. 12 is a control routine executed by the control component at the time the amount of ink in the sub-ink tank is detected when the operation mode of the ink jet recording apparatus is switched to sleep mode.

A control routine for detecting the amount of ink in the sub-ink tank 26 when, for example, the operation mode of the ink jet recording apparatus is set to sleep mode is shown in FIG. 12. First, in step 300, a determination is made as to whether or not a predetermined time has elapsed since the completion of printing. When the determination is affirmative, the routine proceeds to step 302 where an ink amount signal is fetched.

In subsequent step 304, it is determined whether or not the ink amount signal is a low-level signal, namely, the level of the ink in the sub-ink tank 26 is lower than the position of Lo shown in FIG. 7. When the ink amount signal is a high-level signal, namely, when the level of the ink in the sub-ink tank 26 is higher than the position of Lo shown in FIG. 7, the routine proceeds to step 308. When the ink amount signal is a low-level signal, namely, when the level of the ink in the sub-ink tank 26 is lower than the position of Lo shown in FIG. 7, the routine proceeds to step 306 where ink is supplied to the sub-ink tank 26 to its upper limit position B by the ink supply device 32. Subsequently, the routine proceeds to step 308 where the operation mode of the ink jet recording apparatus is set to sleep mode in which energy is saved by significantly reducing standby power. Subsequently, the routine ends.

In this way, the ink jet recording apparatus 10 according to the second embodiment is structured so that the amount of ink in the sub-ink tank 26 for each color is detected during non-printing operations by a signal being outputted from the ink amount sensor 40. Therefore, highly accurate detection of the ink amount can be performed without decreasing the throughput.

Third Embodiment

An ink jet recording apparatus according to a third embodiment is a modification of the ink jet recording apparatus according to the second embodiment.

When a print job includes a large number of pages, the amount of ink in the sub-ink tank 26 may become insufficient during printing. Accordingly, in the ink jet recording apparatus according to the third embodiment, when it is determined that the number of pixels which have been printed exceeds a first predetermined number of pixels X2, the amount of ink in the sub-ink tank 26 is detected. In this case, in order to reduce as much unnecessary detection of the ink amount as possible, the predetermined number of pixels printed X2 is set for each of the sub-ink tanks 26 (i.e., for each color), and it is determined for each of the sub-ink tanks 26 whether or not the number of pixels which have been printed exceeds the first number of pixels X2. The first number of pixels X2 is a number of printed pixels, which number corresponds to a predetermined amount of ink which has been used. The first number of pixels X2 can be appropriately selected by a user.

Figure 13:
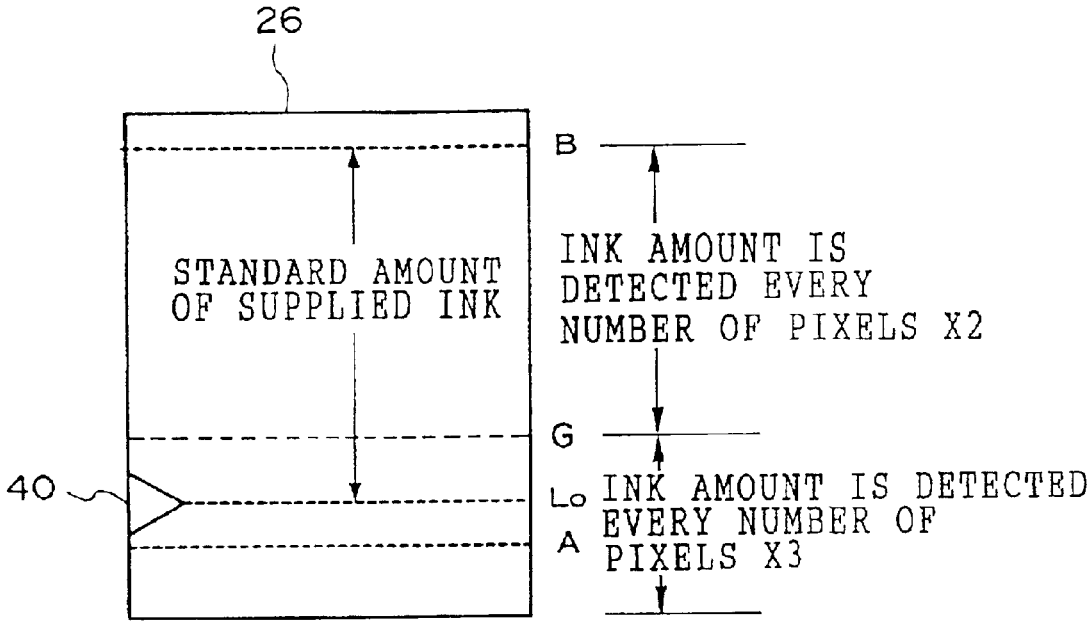
FIG. 13 is an explanatory view showing the relationship between predetermined numbers of printed pixels and the amount of ink in the sub-ink tank, which predetermined numbers are set so that the amount of ink in the sub-ink tank is detected when the number of printed pixels is larger than the predetermined number of printed pixels.

For example, as shown in FIG. 13, the first number of pixels X2 is preferably reset to a second number of pixels X3, which is smaller than the predetermined first number of pixels X2, when the amount of the ink in the sub-ink tank 26 becomes G, which is a predetermined value close to but larger than Lo. In this way, until the amount of ink in the sub-ink tank 26 becomes less than the predetermined value G, the ink amount is detected based on the pixel count over relatively long time intervals. However, once the amount of ink in the sub-ink tank 26 becomes less than the predetermined value G, the ink amount is detected over shorter time intervals, based on the direct detection of the amount of ink in the sub-ink tank 26.

Figure 14:
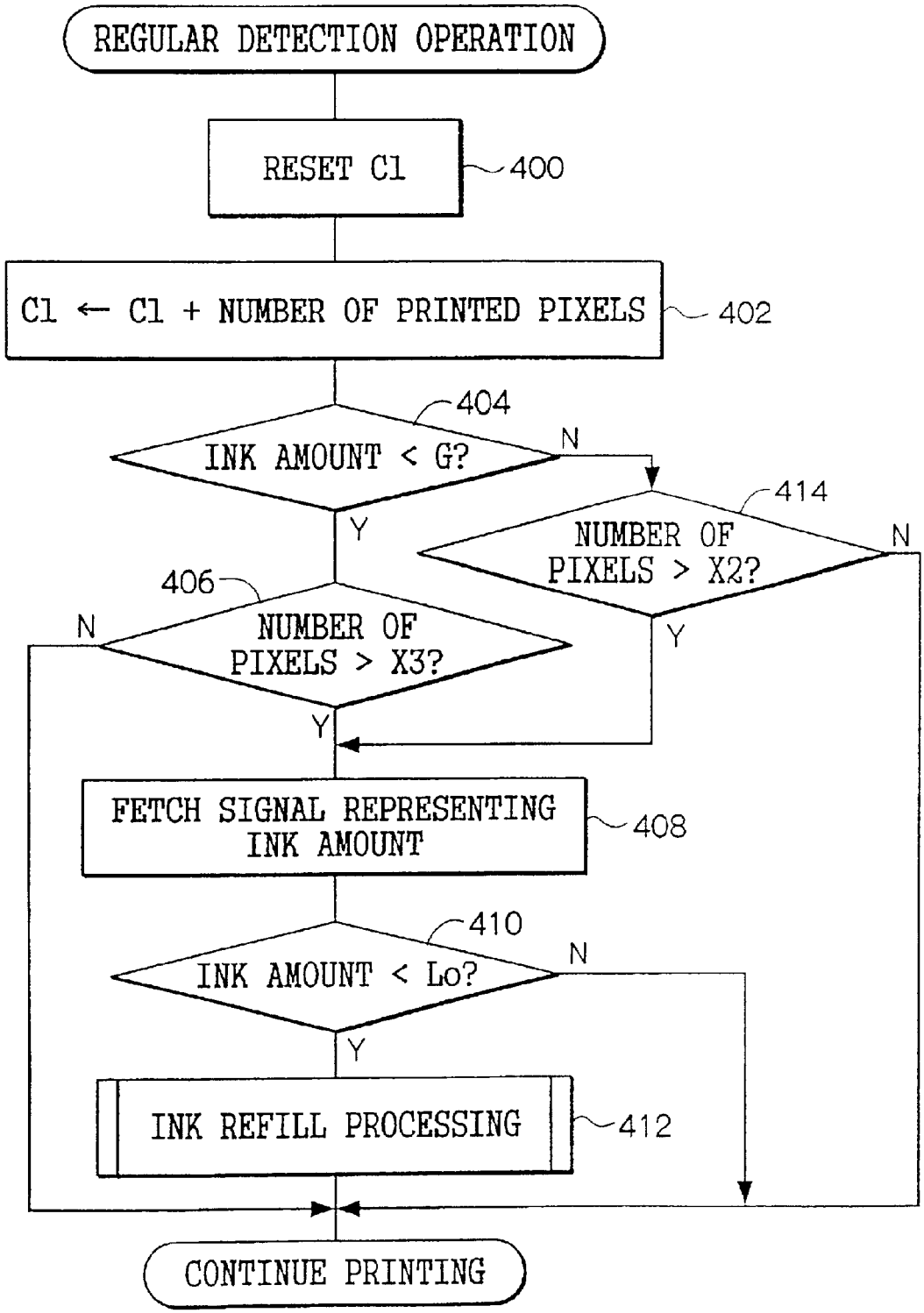
FIG. 14 is a control routine executed by the control component in order to detect the amount of ink in the sub-ink tank when the number of printed pixels is larger than the predetermined number of pixels.

For example, a routine shown in FIG. 14 can be applied as an example of regular detection operation. In the routine in FIG. 14, when execution of a print job is instructed, the current pixel count C1 is first reset in step 400. Although the current pixel count C1 is reset, the total number of printed pixels is maintained. In subsequent step 402, along with the execution of the print job, the number of pixels which corresponds to the amount of ink actually jetted from the ink jet recording head is added to the pixel count C1. In this way, the pixel count C1 is incremented by the number of pixels corresponding to the amount of ink jetted from the ink jet recording head.

In subsequent step 404, it is determined whether or not the amount of ink in the sub-ink tank 26 is less than the predetermined value G. When the determination in step 404 is negative, the routine proceeds to step 414 where it is determined whether or not the number of pixels for a subsequent print job exceeds the first number of pixels X2. When the determination in step 414 is affirmative, the routine proceeds to step 408. When the determination in step 414 is negative, the routine ends.

When the determination in step 404 is affirmative, the routine proceeds to step 406 where it is determined whether or not the number of pixels for the subsequent print job exceeds the second number of pixels X3. The second number of pixels X3 is a number of pixels printed which is less than the first number of pixels X2, and can be appropriately selected. The second number of pixels X3 is preferably set to a number of pixels which can be printed or less even after it is determined that the level of the ink in the sub-ink tank 26 is below Lo and the insufficient amount of ink in the sub-ink tank 26 is detected.

When the determination in step 406 is negative, the routine ends. When the determination in step 406 is affirmative, the routine proceeds to step 408 where an ink amount signal outputted from the ink amount sensor 40 is fetched.

In subsequent step 410, based on the fetched ink amount signal, it is determined whether the amount of ink in the sub-ink tank 26 is less than a predetermined lower limit Lo. When the determination is negative, the routine ends. When the determination is affirmative, the routine proceeds to 412 where the ink refill processing is performed. Subsequently, the routine ends.

As described above, in the third embodiment, until the amount of ink in the sub-ink tank 26 reaches G which is near Lo, the amount of ink in the sub-ink tank 26 is detected based on the pixel count over relatively long time intervals. Once the amount of the ink becomes G, the amount of ink in the sub-ink tank 26 is accurately detected based on the output from the ink amount sensor 40 over relatively short time intervals.

When the amount of ink in the sub-ink tank 26 is large, detection is carried out over long detection intervals. Therefore, the number of times the printing processing is interrupted for detecting the amount of ink in the sub-ink tank 26 can be decreased, and loss time during the printing processing can be made as short as possible. Further, when the amount of ink in the sub-ink tank 26 becomes small, the amount of ink in the sub-ink tank 26 is detected over shorter detection intervals. Thus, detection can be performed at an appropriate time.

Fourth Embodiment

An ink jet recording apparatus according to a fourth embodiment is another modification of the ink jet recording apparatus according to the second embodiment, and is structured so that the amount of ink in the sub-ink tank 26 is detected during the printing processing for a print job as well. In the fourth embodiment, the amount of ink to be used for each of pages forming a print job is assumed based on the pixel count. When the pixel count reaches a predetermined number of sheets D1, the amount of ink in the sub-ink tank 26 is detected.

Figure 15:
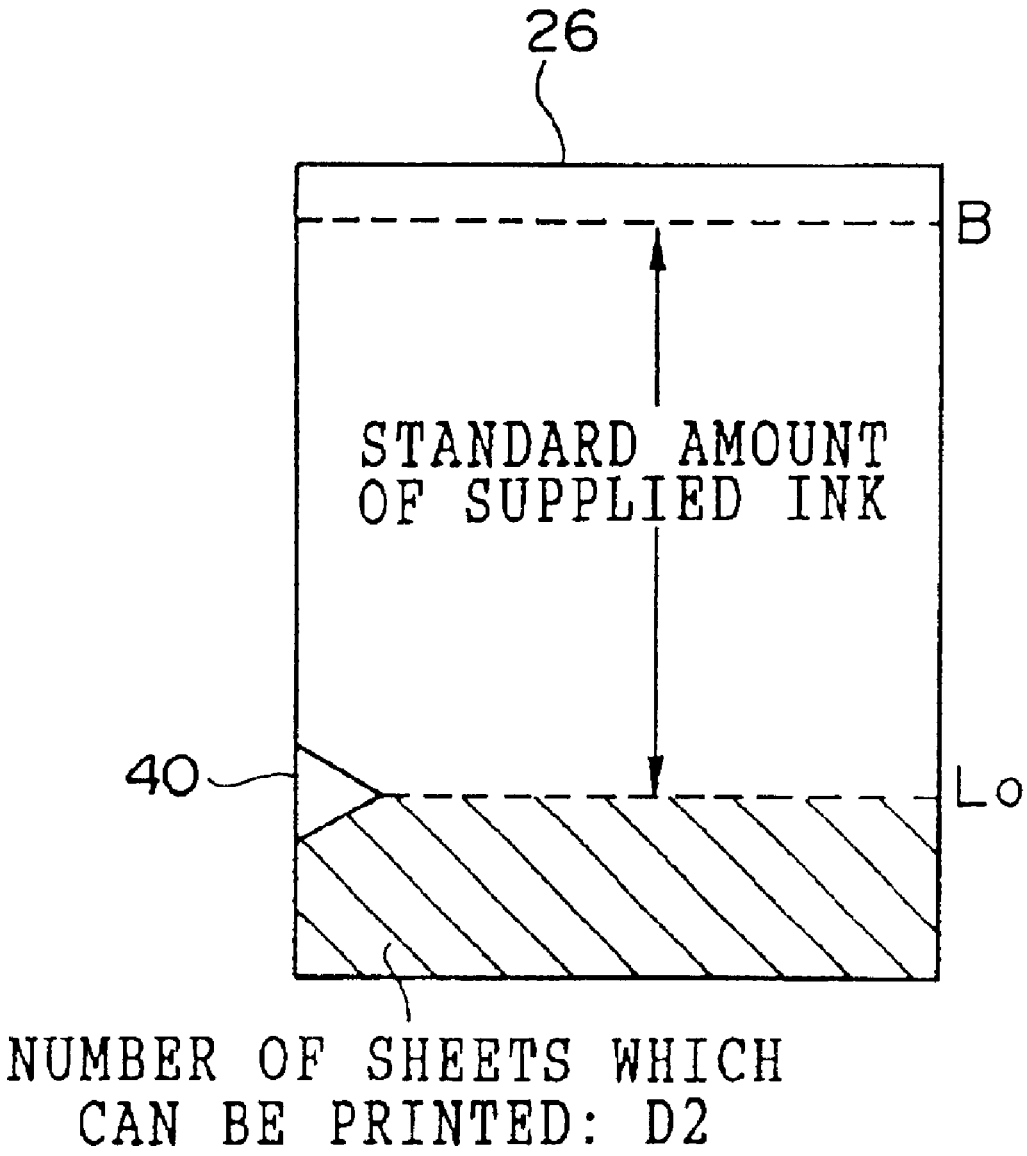
FIG. 15 is an explanatory view showing a remaining amount of ink which corresponds to a printable number of sheets, in a case where the amount of ink remaining in the sub-ink tank is detected when the amount of ink which was used for each page in the print job, based on the pixel count, is estimated to have reached a fixed interval number of sheets, which is set to be a smaller number of sheets than the printable number of sheets.

The fourth embodiment is different from the other embodiments in that the predetermined number of sheets D1 is set as follows. The ink amount sensor 40 is mounted to the sub-ink tank 26 at a portion higher than the bottom surface thereof. Accordingly, as shown in FIG. 15, even after the level of the ink in the sub-ink tank 26 is detected as being low, a predetermined number of sheets (hereinafter referred to as the "number of sheets which can be printed") D2 can still be printed.

When the number of sheets D1 is set to be larger than the number of sheets which can be printed D2, image defects may be caused by shortage of ink depending on the timing for the detection of the ink amount, such as the case in which the level of the ink in the sub-ink tank 26 is substantially below the ink amount sensor 40. For this reason, in the fourth embodiment, the predetermined number of sheets D1 is set to be smaller than the number of sheets which can be printed D2. As a result, even if the amount of ink is detected when the ink level is below the ink amount sensor 40, printing can be continued without the ink running out.

The number of sheets D1 is preferably set on the basis of the coverage area for the best quality. As a result, printing of files having a large coverage area can be ensured. The coverage area can be specified by a user.

Figure 16:
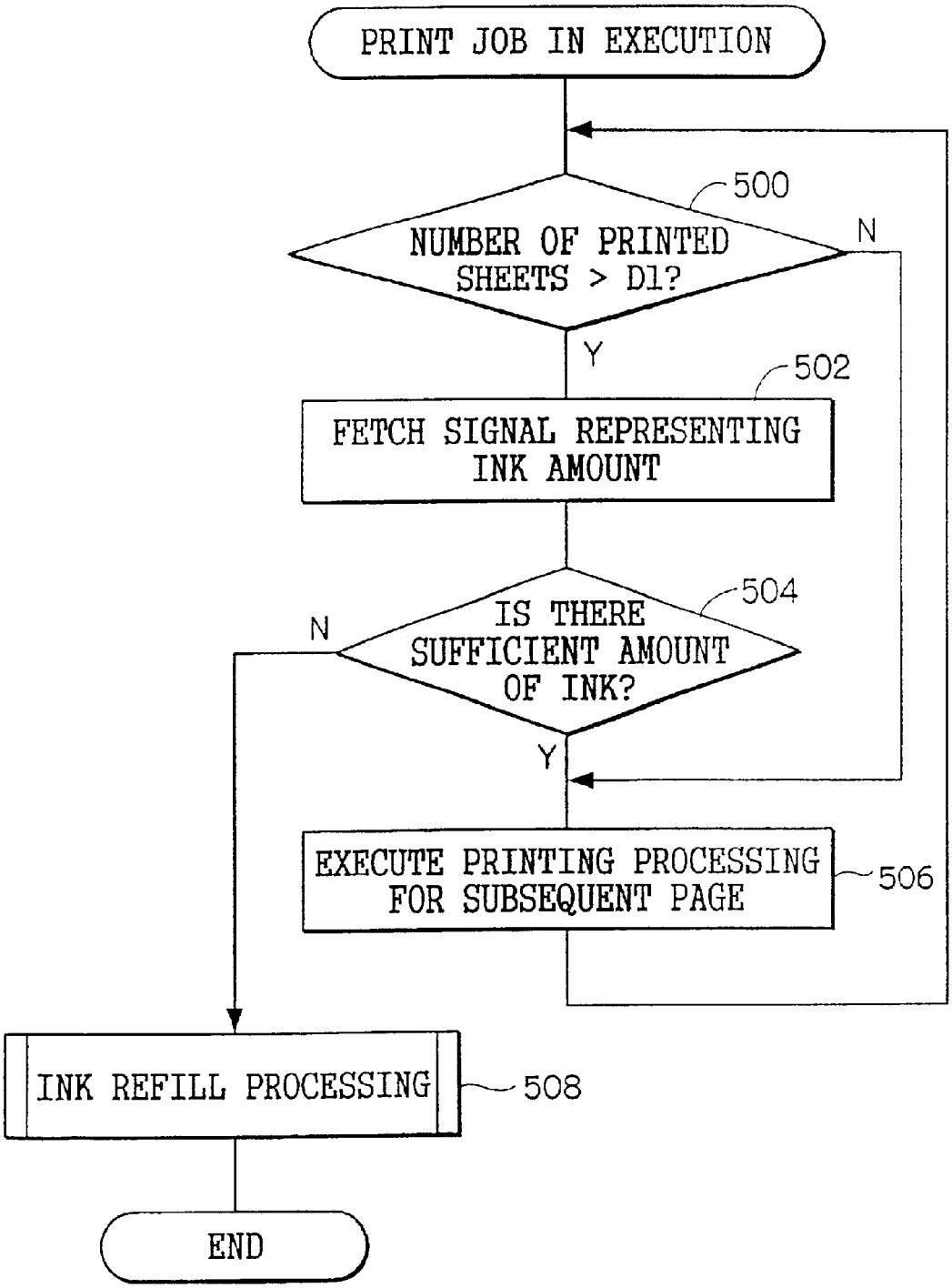
FIG. 16 is a control routine executed by the control component in order to detect the amount of ink in the sub-ink tank when the amount of ink which was used for each page in the print job, based on the pixel count, is estimated to have reached a fixed interval number of sheets, which is set to be a smaller number of sheets than the printable number of sheets.

Further, when a print job includes a plurality of pages, as shown in FIG. 16, for example, it is determined in step 500 whether the number of sheets which have been printed exceeds the number of sheets D1 during the printing processing for the print job. When the determination is negative, the routine proceeds to step 506 where the printing processing for a subsequent page is performed. Subsequently, the routine returns to step 500.

When the determination in step 500 is affirmative, the routine proceeds to step 502 where an ink amount signal outputted from the ink amount sensor 40 is fetched (i.e., sensing of ink amount). In subsequent step 504, it is determined whether or not a sufficient amount of ink is in the sub-ink tank 26, namely, the ink amount signal is a high-level signal. When the determination in step 504 is affirmative, namely, when it is determined that the ink amount signal is a high-level signal and a sufficient amount of ink is in the sub-ink tank 26, the routine proceeds to step 506 where the printing processing for a subsequent page is performed. The routine then returns to step 500, and the above-described process is repeated.

On the other hand, when the determination in step 504 is negative, namely, when it is determined that the ink amount signal is a low-level signal and the amount of ink in the sub-ink tank 26 is insufficient, the routine proceeds to step 508 where ink is supplied to the sub-ink tank 26 to the upper limit position B by the ink supply device 32.

As described above, in the fourth embodiment, the predetermined number of sheets D1 is set to be smaller than the number of sheets which can be printed D2. Accordingly, printing can be continued at any time without the ink running out. Further, when a print job includes a plurality of pages, and the plurality of pages are to be continuously printed, the amount of ink in the sub-ink tank 26 is detected after printing of each page is finished. Therefore, problems such as interruption of printing can be prevented.

As described above, the present invention has effects in that problems such as image defects caused by shortage of ink and decreases in the printing speed can be prevented.

What is claimed is:

1. An ink jet recording apparatus comprising:

a recording head including an ink tank for storing ink, the recording head being driven and controlled based on image information so as to jet onto a recording medium ink supplied from the ink tank;

detecting means for detecting an amount of ink remaining in the ink tank;

supply means including a main tank for storing ink, the supply means supplying ink from the main tank to the ink tank when the recording head is disposed at an ink supplying position; and control means for controlling the supply means so that, when the remaining amount of ink detected by the detecting means is above a lower limit, ink is supplied during non-recording time in an amount corresponding to the amount of ink used.

2. The ink jet recording apparatus of claim 1, wherein the control means estimates, based on the image information, the amount of ink used.

3. The ink jet recording apparatus of claim 1, wherein the control means determines whether or not the amount of ink used exceeds a predetermined value, and, when the determination is affirmative, controls the supply means during non-recording time so that ink is supplied.

4. The ink jet recording apparatus of claim 3, wherein the predetermined value corresponds to an amount of ink which can be supplied during non-recording time without interrupting recording.

5. The inkjet recording apparatus of claim 3, wherein the predetermined value is no more than an upper limit of the ink remaining in the ink tank.

6. The inkjet recording apparatus of claim 1, wherein the lower limit is an amount of ink which can be used for a predetermined amount of printing.

7. An ink jet recording apparatus comprising:

an ink jet recording head including an ink tank to which ink is supplied, the inkjet recording head printing by jetting the ink from the ink tank in accordance with image information in a print job;

remaining ink amount detecting means for detecting an amount of ink remaining in the ink tank at predetermined time intervals and outputting an empty signal indicating shortage of ink when the amount of ink is no more than a lower limit;

ink supply means including a main tank for storing ink, the ink supply means supplying ink from the main tank to the ink tank in response to the empty signal outputted from the remaining ink amount detecting means; and control means for controlling the ink supply means such that, when the remaining amount of ink detected by the remaining ink amount detecting means is above the lower limit, ink is supplied to the ink tank in an amount corresponding to the amount of ink used.

8. The inkjet recording apparatus of claim 7, wherein the control means controls the ink supply means such that ink is supplied to the ink tank when the print job is not being printed.

9. An ink jet recording apparatus comprising:

a recording head including an ink tank for storing ink, the recording head being driven and controlled based on image information so as to jet onto a recording medium ink supplied from the ink tank, wherein the image information is a number of printed pixels;

detecting means for detecting an amount of ink remaining in the ink tank;

supply means including a main tank for storing ink, the supply means supplying ink from the main tank to the ink tank when the recording head is disposed at an ink supplying position; and control means for controlling the supply means so that, when the remaining amount of ink detected by the detecting means is above a lower limit, ink is supplied during non-recording time in an amount corresponding to the number of printed pixels.

10. The ink jet recording apparatus of claim 9, wherein the control means estimates, based on the image information, the amount of ink used.

11. The ink jet recording apparatus of claim 9, wherein the control means determines whether or not the amount of ink used exceeds a predetermined value, and, when the determination is affirmative, controls the supply means during non-recording time so that ink is supplied.

12. The ink jet recording apparatus of claim 11, wherein the predetermined value corresponds to an amount of ink which can be supplied during non-recording time without interrupting recording.

13. The inkjet recording apparatus of claim 11, wherein the predetermined value is no more than an upper limit of the ink remaining in the ink tank.

14. The inkjet recording apparatus of claim 9, wherein the lower limit is an amount of ink which can be used for a predetermined amount of printing.

15. The ink jet recording apparatus of claim 9, wherein the control means determines whether the number of printed pixels exceeds a predetermined number of pixels, and, when the determination is affirmative, controls the supply means during non-recording time so that ink it supplied.

16. The inkjet recording apparatus of claim 9, wherein the control means calculates a percentage of an ink amount corresponding to the number of printed pixels and controls the supply means to supply the percentage of the ink amount.

17. The image recording apparatus of claim 16, wherein the percentage of the ink amount is in a range of 60 percent to 95 percent of the ink amount corresponding to the number of printed pixels.

18. An ink jet recording apparatus comprising:

an ink jet recording head including an ink tank to which ink is supplied, the inkjet recording head printing by jetting the ink from the ink tank in accordance with image information in a print job, wherein the image information is a number of printed pixels;

remaining ink amount detecting means for detecting an amount of ink remaining in the ink tank at predetermined time intervals and outputting an empty signal indicating shortage of ink when the amount of ink is no more than a lower limit;

ink supply means including a main tank for storing ink, the ink supply means supplying ink from the main tank to the ink tank in response to the empty signal outputted from the remaining ink amount detecting means; and control means for controlling the ink supply means such that, when the remaining amount of ink detected by the remaining ink amount detecting means is above the lower limit, ink is supplied to the ink tank in an amount corresponding to the number of printed pixels.

19. The inkjet recording apparatus of claim 18, wherein the control means controls the ink supply means such that ink is supplied to the ink tank when the print job is not being printed.

* * * * *